US010889966B2

(12) United States Patent
Parzynski, Jr. et al.

(10) Patent No.: US 10,889,966 B2
(45) Date of Patent: Jan. 12, 2021

(54) DRAFTED TOOL BIT AND BLADE ASSEMBLY

(71) Applicant: Caterpillar Inc., Peoria, IL (US)

(72) Inventors: David Bruno Parzynski, Jr., Peoria, IL (US); Thomas Marshall Congdon, Dunlap, IL (US)

(73) Assignee: Caterpillar Inc., Peoria, IL (US)

( * ) Notice: Subject to any disclaimer, the term of this patent is extended or adjusted under 35 U.S.C. 154(b) by 116 days.

(21) Appl. No.: 15/952,955

(22) Filed: Apr. 13, 2018

(65) Prior Publication Data

US 2019/0316327 A1 Oct. 17, 2019

(51) Int. Cl.
*E02F 9/28* (2006.01)
*E02F 3/815* (2006.01)

(52) U.S. Cl.
CPC ..... *E02F 9/2858* (2013.01); *E02F 3/8152* (2013.01); *E02F 9/2833* (2013.01)

(58) Field of Classification Search
CPC ..... E02F 9/2808; E02F 9/2816; E02F 9/2858; E02F 3/815; E02F 3/8152; E02F 9/2833
USPC ..... 172/701.1, 701.3, 777
See application file for complete search history.

(56) References Cited

U.S. PATENT DOCUMENTS 1,927,818 A * 9/1933 Brodersen ..... E02F 9/285 299/105
2,062,232 A * 11/1936 Pogue ..... E01C 23/088 172/71
2,305,653 A * 12/1942 Ward ..... E02F 9/2825 37/453
2,385,395 A * 9/1945 Baer ..... E02F 9/2833 37/458
3,136,077 A * 6/1964 Troeppl ..... E02F 9/28 37/452
3,286,379 A * 11/1966 Benetti ..... E02F 9/285 37/452
3,312,002 A * 4/1967 Benetti ..... E02F 9/2841 37/452
4,655,508 A * 4/1987 Tomlinson ..... E21B 10/567 299/112 R
4,727,664 A * 3/1988 Hemphill ..... E02F 9/2866 37/455
4,753,299 A * 6/1988 Meyers ..... E02F 9/2825 172/701.3
4,949,481 A * 8/1990 Fellner ..... E02F 9/2858 172/713
5,224,555 A * 7/1993 Bain et al. ..... E02F 3/8152 172/701.3

(Continued)

FOREIGN PATENT DOCUMENTS

EP 2489830 8/2012
WO 2016138586 9/2016

*Primary Examiner* — Thomas B Will
*Assistant Examiner* — Joel F. Mitchell
(74) *Attorney, Agent, or Firm* — Law Office of Kurt J. Fugman LLC

(57) ABSTRACT

A tool bit comprises a shank portion defining a longitudinal axis, and a working portion extending downwardly axially from the shank portion. The working portion includes a rear region, a front working region, a first side region and a second side region, and the first side region and the second side region define an angle of extension measured in a plane perpendicular to the longitudinal axis, forming a wider front working region than the rear region in a plane perpendicular to the longitudinal axis.

19 Claims, 29 Drawing Sheets

(56) References Cited

U.S. PATENT DOCUMENTS

| | | | | |
|---|---|---|---|---|
| 6,490,816 | B2 * | 12/2002 | Ketting | E02F 9/2858 37/454 |
| 8,191,291 | B2 * | 6/2012 | Vanderpoorten et al. | E02F 9/2858 37/453 |
| 9,222,353 | B2 * | 12/2015 | Morris et al. | E21C 35/1933 |
| 10,352,022 | B2 * | 7/2019 | Hunt | E02F 3/8152 |
| 2009/0174252 | A1 | 7/2009 | Morris et al. | |

* cited by examiner

DRAFTED TOOL BIT AND BLADE ASSEMBLY

TECHNICAL FIELD

The present disclosure relates to cast serrated cutting edges formed by replaceable bits used by motor graders or other similar equipment. More specifically, the present disclosure relates to tool bits having draft that are attached to a blade assembly of a machine.

BACKGROUND

Machines such as motor graders employ a long blade that is used to level work surfaces during the grading phase of a construction project or the like. These blades often encounter abrasive material such as rocks, dirt, etc. that can degrade the working edge, making such blades ineffective for their intended purpose. Some blades have a serrated cutting edge meaning that the edge is not continuously flat but undulates up and down, forming teeth. A drawback to such blades is that the teeth may be more easily worn than is desired. In harsh environments, such blades may be rendered dull, with the teeth having been essentially removed, after 100-200 hours of operation. Necessitating their replacement. Serrated cutting edges are sometimes provided to improve penetration, etc.

Accordingly, devices have been developed that allow the teeth or bits that form the serrated cutting edges to be replaced. Typically, a moldboard extends downwardly from and is connected to the machine. An adapter board is attached to the to the moldboard and extends downwardly from the moldboard. So, the bottom free end of the adapter board is disposed adjacent the ground or other work surface. A plurality of bits are removably attached to the free end of the adapter board so that they may engage the ground or other work surface. In some applications, the ground or other work surface may be hardened or otherwise difficult to penetrate. This may lead to increased wear and/or fracture of the tool bit.

Accordingly, there exists a need for providing a tool bit that is more robust than heretofore devised.

SUMMARY OF THE DISCLOSURE

A tool bit for use with a blade assembly of a grading machine according to an embodiment of the present disclosure is provided. The tool bit may comprise a shank portion defining a longitudinal axis, and a working portion extending downwardly axially from the shank portion. The working portion includes a rear region, a front working region, a first side region and a second side region, and the first side region and the second side region define an angle of extension measured in a plane perpendicular to the longitudinal axis, forming a wider front working region than the rear region in a plane perpendicular to the longitudinal axis.

A tool bit for use with a blade assembly of a grading machine according to an embodiment of the present disclosure is provided. The tool bit may comprise a shank portion defining a longitudinal axis, and a working portion extending downwardly axially from the shank portion. The working portion includes a rear region, a front working region, a first side region and a second side region, and the first side region or the second side region include a first vertical surface disposed longitudinally adjacent the shank portion, and a first drafted side surface extending from the first vertical surface.

An insert configured to be attached to the notch of a tool bit for use with a grading machine according to an embodiment of the present disclosure is provided. The insert may comprise a first side face, a second side face, a top face, a bottom face, a rear face, and a front region including a first flat face, and a second flat face forming an obtuse included angle with the first flat face on the top face ranging from 120 to 180 degrees.

DETAILED DESCRIPTION

Figure 1:
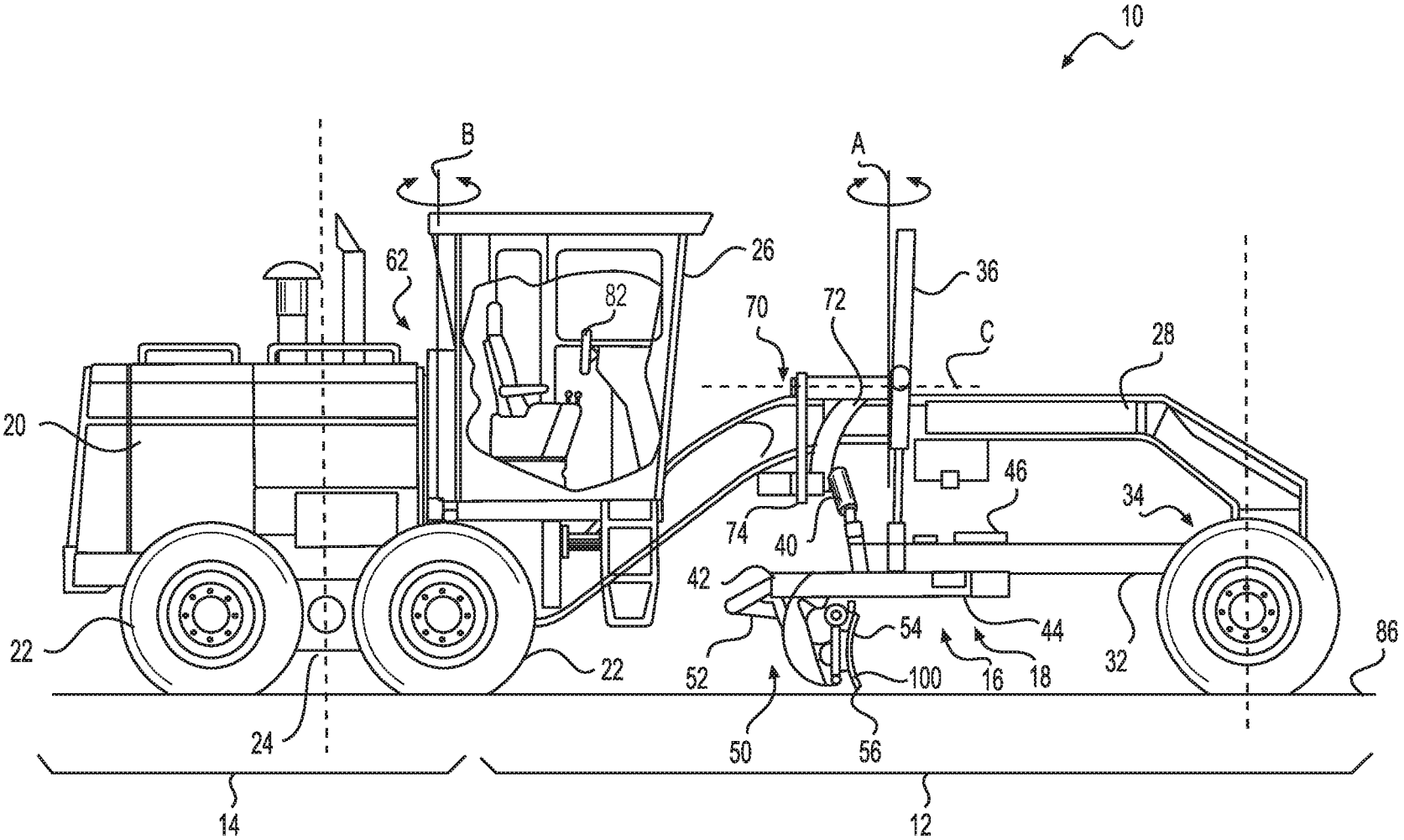
FIG. 1 is a side view of a motor grader that may employ a blade assembly and/or a tool bit according to an embodiment of the present disclosure.

Reference will now be made in detail to embodiments of the disclosure, examples of which are illustrated in the accompanying drawings. Wherever possible, the same reference numbers will be used throughout the drawings to refer to the same or like parts. In some cases, a reference number will be indicated in this specification and the drawings will show the reference number followed by a letter for example, 100*a*, 100*b* or a prime indicator such as 100', 100" etc. It is to be understood that the use of letters or primes immediately after a reference number indicates that these features are similarly shaped and have similar function as is often the case when geometry is mirrored about a plane of symmetry. For ease of explanation in this specification, letters or primes will often not be included herein but may be shown in the drawings to indicate duplications of features discussed within this written specification.

A blade assembly using tool bits with arcuate surfaces according to an embodiment of the present disclosure will be described. Then, a tool bit with an arcuate surface will be discussed.

First, a machine will now be described to give the reader the proper context for understanding how various embodiments of the present disclosure are used to level or grade a work surface. It is to be understood that this description is given as exemplary and not in any limiting sense. Any embodiment of an apparatus or method described herein may be used in conjunction with any suitable machine.

FIG. 1 is a side view of a motor grader in accordance with one embodiment of the present disclosure. The motor grader 10 includes a front frame 12, rear frame 14, and a work implement 16, e.g., a blade assembly 18, also referred to as a drawbar-circle-moldboard assembly (DCM). The rear frame 14 includes a power source (not shown), contained within a rear compartment 20, that is operatively coupled through a transmission (not shown) to rear traction devices or wheels 22 for primary machine propulsion.

As shown, the rear wheels 22 are operatively supported on tandems 24 which are pivotally connected to the machine between the rear wheels 22 on each side of the motor grader 10. The power source may be, for example, a diesel engine, a gasoline engine, a natural gas engine, or any other engine known in the art. The power source may also be an electric motor linked to a fuel cell, capacitive storage device, battery, or another source of power known in the art. The transmission may be a mechanical transmission, hydraulic transmission, or any other transmission type known in the art. The transmission may be operable to produce multiple output speed ratios (or a continuously variable speed ratio) between the power source and driven traction devices.

The front frame 12 supports an operator station 26 that contains operator controls 82, along with a variety of displays or indicators used to convey information to the operator, for primary operation of the motor grader 10. The front frame 12 also includes a beam 28 that supports the blade assembly 18 and which is employed to move the blade assembly 100 to a wide range of positions relative to the motor grader 10. The blade assembly 18 includes a drawbar 32 pivotally mounted to a first end 34 of the beam 28 via a ball joint (not shown). The position of the drawbar 32 is controlled by three hydraulic cylinders: a right lift cylinder 36 and left lift cylinder (not shown) that control vertical movement, and a center shift cylinder 40 that controls horizontal movement. The right and left lift cylinders are connected to a coupling 70 that includes lift arms 72 pivotally connected to the beam 28 for rotation about axis C. A bottom portion of the coupling 70 has an adjustable length horizontal member 74 that is connected to the center shift cylinder 40.

The drawbar 32 includes a large, flat plate, commonly referred to as a yoke plate 42. Beneath the yoke plate 42 is a circular gear arrangement and mount, commonly referred to as the circle 44. The circle 44 is rotated by, for example, a hydraulic motor referred to as the circle drive 46. Rotation of the circle 44 by the circle drive 46 rotates the attached blade assembly 100 about an axis A perpendicular to a plane of the drawbar yoke plate 42. The blade cutting angle is defined as the angle of the blade assembly 100 relative to a longitudinal axis of the front frame 12. For example, at a zero degree blade cutting angle, the blade assembly 100 is aligned at a right angle to the longitudinal axis of the front frame 12 and beam 28.

The blade assembly 100 is also mounted to the circle 44 via a pivot assembly 50 that allows for tilting of the blade assembly 100 relative to the circle 44. A blade tip cylinder 52 is used to tilt the blade assembly 100 forward or rearward. In other words, the blade tip cylinder 52 is used to tip or tilt a top edge 54 relative to the bottom cutting edge 56 of the blade 30, which is commonly referred to as blade tip. The blade assembly 100 is also mounted to a sliding joint associated with the circle 44 that allows the blade assembly 100 to be slid or shifted from side-to-side relative to the circle 44. The side-to-side shift is commonly referred to as blade side shift. A side shift cylinder (not shown) is used to control the blade side shift. The placement of the blade assembly 100 allows a work surface 86 such as soil, dirt, rocks, etc. to be leveled or graded as desired. The motor grader 10 includes an articulation joint 62 that pivotally connects front frame 12 and rear frame 14, allowing for complex movement of the motor grader, and the blade.

U.S. Pat. No. 8,490,711 to Polumati illustrates another motor grader with fewer axes of movement than that just described with respect to FIG. 1. It is contemplated that such a motor grader could also employ a blade according to various embodiments of the present disclosure, etc. Other machines than graders may use various embodiments of the present disclosure.

Figure 2:
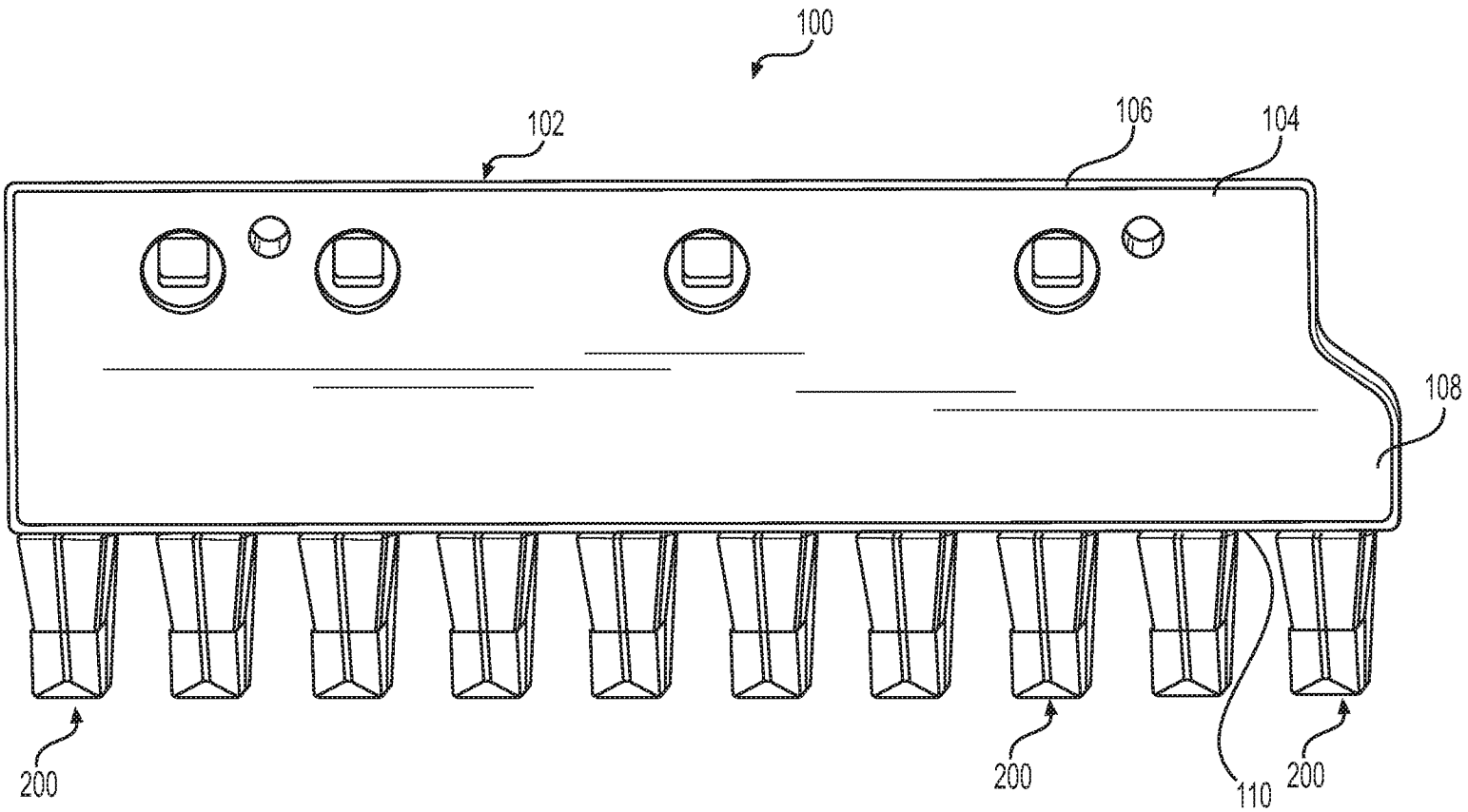
FIG. 2 is a front oriented perspective view of a blade assembly according to an embodiment of the present disclosure utilizing a tool bit with arcuate bit surfaces shown in isolation from the machine of FIG. 1.

Turning now to FIG. 2, a blade assembly 100 for use with a grading machine 10 according to an embodiment of the present disclosure will be described. The blade assembly 100 comprises an adapter board 102 defining an upper adapter board attachment portion 104, terminating in an upper adapter board free end 106. This portion 104 is used to attach to a moldboard (not shown). The adapter board 100 further comprising a lower tool bit attachment portion 108, terminating in a lower adapter board free end 110. The lower tool bit attachment portion 108 defines a width W. A plurality of tool bits 200 are provided that are configured to be attached to the adapter board 102. While FIG. 2 shows the tool bits 200 already attached to the adapter board 102 via mounting hardware (not shown), it is to be understood that the tool bits 200 may be supplied with the adapter board 102 or separately from the adapter board 102, without being attached to the adapter board 102.

Figure 3:
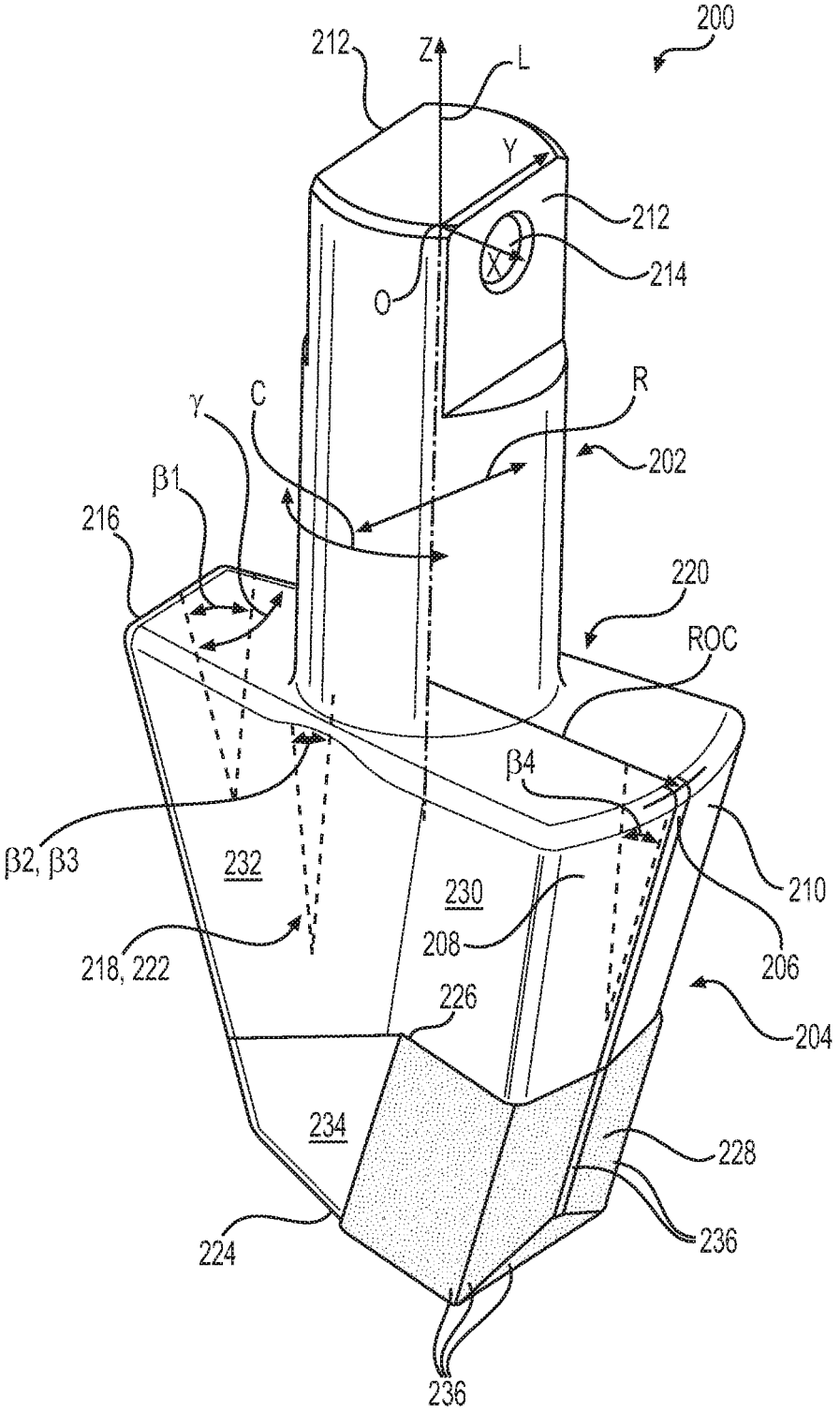
FIG. 3 is a perspective view of a first embodiment of the present disclosure showing a tool bit utilizing an arcuate bit surface that may be used in conjunction with the blade assembly of FIG. 2.

Looking now at FIGS. 2 and 3, each tool bit 200 may include a shank portion 202 defining a longitudinal axis L, and a working portion 204. The working portion 204 may include at least a first arcuate surface 206 disposed longitudinally adjacent the shank portion 202, and the at least first arcuate surface 206 may define a radius of curvature ROC (measured in a plane perpendicular to the longitudinal axis L) that is equal to or greater than the width W of the lower tool bit attachment portion 108 of the adapter board 102. Examples of arcuate surfaces include radial, elliptical, polynomial surfaces, etc.

As best seen in FIGS. 2, and 7 thru 10, the lower tool bit attachment portion 108 of the adapter board 102 may define a plurality of cylindrical thru-bores 112. As shown in FIG. 3, the shank portion 202 of the tool bit 200 may include a cylindrical configuration defining a circumferential direction C and a radial direction R. The shank portion 202 may be configured to fit snugly within one of the plurality of cylindrical thru-bores 112.

Focusing on FIG. 3, the working portion 204 of the tool bit 200 includes a second arcuate surface 208 disposed adjacent the first arcuate surface 206 circumferentially on one side of the first arcuate surface 206 and a third arcuate surface 210 disposed adjacent the first arcuate surface 206 on the other side of the first arcuate surface 206. The shank portion 202 defines two flat surfaces 212 circumferentially aligned with the first arcuate surface 206, the two flat surfaces 212 partially defining a cross-hole 214 extending radially thru the shank portion 202. Mounting hardware (not shown) may be used in conjunction with the cross-hole 214 of the shank portion 202 for retaining the tool bit 200 to the adapter board 102. As best seen in FIGS. 7 thru 10, the flat surfaces 212 may be used with an orientation plate 114 that sits on top of the lower tool bit attachment portion 108 to control the angle of inclination $\alpha$ of the tool bits 200 relative to the centerline CL of the blade assembly 100.

Returning to FIG. 3, the first arcuate surface 206, second arcuate surface 208 and/or third arcuate surface 210 may define a radius of curvature ROC ranging from 50 to 65 mm. As alluded to earlier herein, the radius of curvature ROC may be adjusted based on the width W of the lower tool bit attachment portion 108 of the adapter board 102 and is measured in a plane perpendicular to the longitudinal axis L. As used herein, the width W is often the minimum dimension of the lower tool bit attachment portion 108 measured along a direction perpendicular to the longitudinal axis L of the shank portion 202 (parallel to CL in FIG. 7). The tool bit 200 may further comprising a rear face 216, a first side region 218 extending from the second arcuate surface 208 to the rear face 216, and a second side region 220 extending from the third arcuate surface 210 to the rear face 216. The first side region 218 may be divided into a first set of multiple side surfaces 222 and the second side region 220 may be divided into a second set of multiple side surfaces (not shown). The working portion 204 defines a free axial end 224 and a notch 226 disposed proximate the free axial end 224. An insert 228 or tile may be disposed in the notch 226. The insert 228 may be made from a carbide material such as Tungsten Carbide with a binding agent (such as Cobalt). The tool bit 200 itself or the adapter board 102 may be forged or cast using iron, grey cast-iron, steel or any other suitable material.

Various surfaces of the working portion 204 of the tool bit 200 may be drafted relative to the longitudinal axis L of the shank portion 202, allowing the tool bit 200 to enter and exit the ground or other work surface more easily. The draft angle would be the angle formed between the longitudinal axis L and the surface in a cross-section defined by a plane containing the radial direction R and the longitudinal axis L. The draft angle may be negative, resulting in the width of the cross-section of the working portion, in a plane perpendicular to the longitudinal axis L, decreasing as one progresses upwardly along the longitudinal axis L toward the shank portion (this may be the case in FIG. 4). Alternatively, the draft angle may be positive, resulting in the width of the cross-section of the working portion increasing as one progresses upwardly along the longitudinal axis L toward the shank portion (this may be the case in FIGS. 3, 5 and 6).

As seen in FIG. 3, the rear face 216 may define a first draft angle β1 with the longitudinal axis L ranging from 0 to 30 degrees. Similarly, the first side region 218 may define a second draft angle β2 with the longitudinal axis ranging from 0 to 30 degrees. Likewise, the second side region 220 may define a third draft angle β3 (same as β2 since the tool bit is usually symmetrical) with the longitudinal axis L ranging from 0 to 30 degrees. Also, the first arcuate surface 206, second arcuate surface 208 and/or third arcuate surface 210 define a fourth draft angle β4 with the longitudinal axis L ranging from 0 to 30 degrees. Other draft angles or no draft angle may be provided for any of these surfaces in other embodiments.

For the embodiment shown in FIG. 3, a Cartesian coordinate system X, Y, Z may be placed with its origin O at the longitudinal axis L of the shank portion 202 and its X-axis oriented parallel to the cross-hole 214 of the shank portion 202. The tool bit 200 may be symmetrical about the X-Z plane. This may not the case in other embodiments.

Other configurations of the tool bit are possible and considered to be within the scope of the present disclosure. For example, FIG. 4 discloses another embodiment for a tool bit 300 of the present disclosure similarly configured to that of FIG. 3 except for the following differences. This tool bit 300 includes a first arcuate surface 306, a second arcuate surface 308 and a third arcuate surface 310. The tool bit 300 further comprises a fourth arcuate surface 330 extending circumferentially from the third arcuate surface 310, a fifth arcuate surface 332 extending circumferentially from the fourth arcuate surface 330, and a sixth arcuate surface 334 extending circumferentially from the fifth arcuate surface 332. The angle of extension γ of the tool bit 300 formed in a plane perpendicular to the longitudinal axis L is greater than the angle of extension γ of the tool bit 300 in FIG. 3.

The fourth draft angle β4 of the first, second, third, fourth, fifth, and sixth arcuate surfaces 306, 308, 310, 330, 332, 334 varies more than the fourth draft angle β4 of first, second, and third arcuate surfaces 206, 208, 210 of the embodiments shown in FIG. 3. This forms a depression 336 at the X-Z plane as the arcuate surfaces 306, 308, 310, 330, 332, 334 extend downwardly along the longitudinal axis L. The first draft angle β1 of the rear face 316 may range from 0 to 30 degrees. Similarly, the second draft angle β2 of the first side region 318 and the third draft angle β3 of the second side region 320 may range from 0 to 30 degrees. The radius of curvature ROC of the first, second, third, fourth, fifth and sixth arcuate surfaces 306, 308, 310, 330, 332, 334 may range from 50 to 65 mm for the embodiment shown in FIG. 4. Again, the tool bit 300 is symmetrical about the X-Z plane. This may not be the case in other embodiments of the present disclosure.

A tool bit 200, 300, 400, 500 for use with a blade assembly 100 of a grading machine 10 will now be described with reference to FIGS. 3 thru 6 that may be provided separately from the blade assembly 100. The tool bit 200, 300, 400, 500 may comprise a shank portion 202, 302, 402, 502 defining a longitudinal axis L, and a working portion 204, 304, 404, 504. The working portion 204, 304, 404, 504 includes at least a first arcuate surface 206, 306, 406, 506 disposed longitudinally adjacent the shank portion 202, 302, 402, 502. The shank portion 202, 302, 402, 502 includes a cylindrical configuration defining a circumferential direction C and a radial direction R.

The working portion 204, 304, 404, 504 may include a second arcuate surface 208, 308, 408, 508 disposed adjacent the first arcuate surface 206, 306, 406, 506 circumferentially on one side of the first arcuate surface 206, 306, 406, 506 and a third arcuate surface 210, 310, 410, 510 disposed adjacent the first arcuate surface 206, 306, 406, 506 on the other side of the first arcuate surface 206, 306, 406, 506.

The shank portion 202, 302, 402, 502 may define two flat surfaces 212, 312, 412, 512 circumferentially aligned with the first arcuate surface 206, 306, 406, 506. The two flat surfaces 212, 312, 412, 512 partially defining a cross-hole 214, 314, 414, 514 extending radially thru the shank portion 202, 302, 402, 502. The shank portions 202, 302, 402, 502 may be similarly configured so that they will work with the same adapter board 102 of the blade assembly 100.

The working portion 204, 304, 404, 504 may include a first arcuate surface 206, 306, 406, 506, a second arcuate surface 208, 308, 408, 508 or a third arcuate surface 210, 310, 410, 510 that defines a radius of curvature ROC ranging from 50 to 65 mm.

Figure 4:
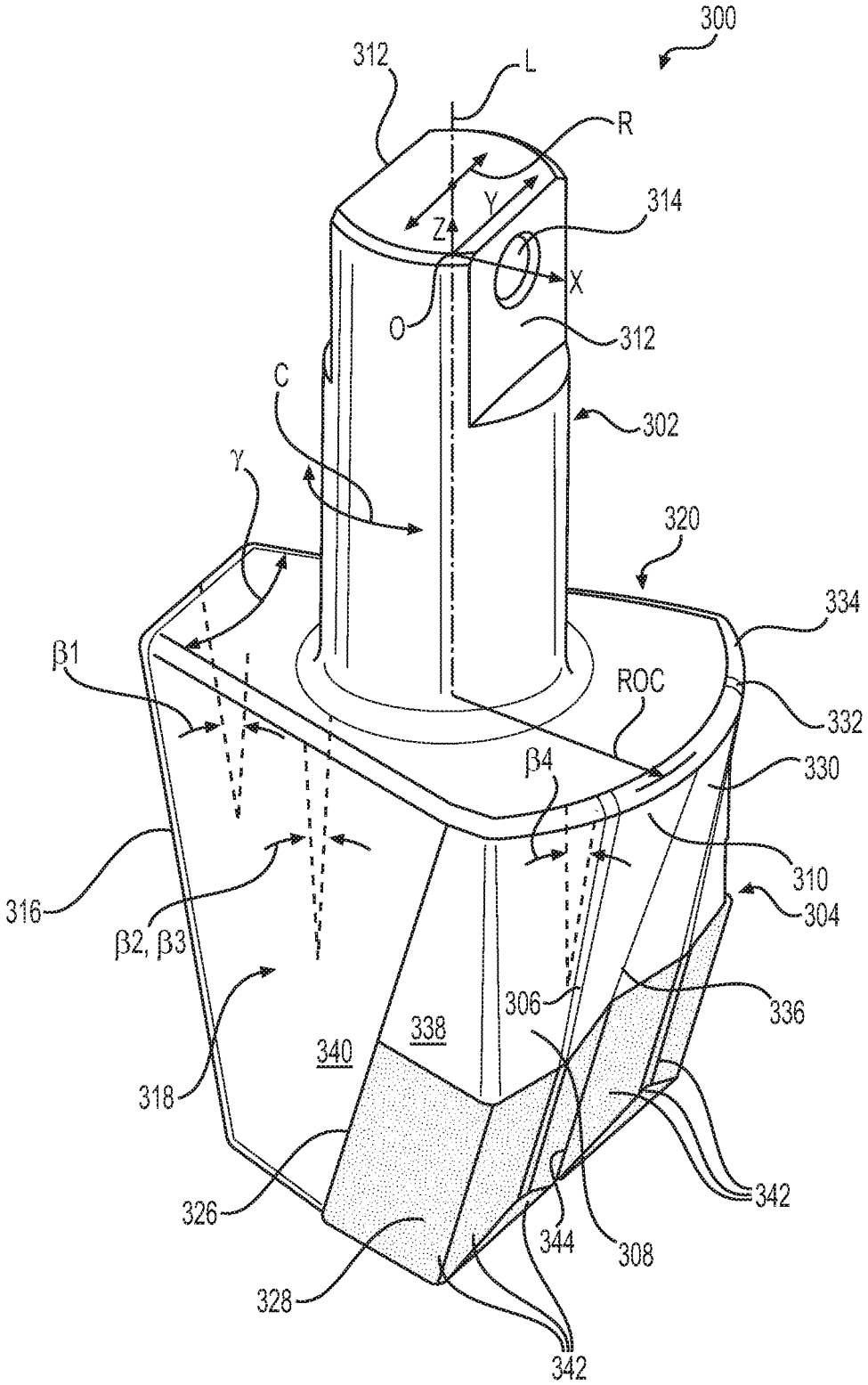
FIG. 4 is a perspective view of a second embodiment of the present disclosure showing a tool bit utilizing a longer arcuate bit surface than the first embodiment of FIG. 3 that may be used in conjunction with the blade assembly of FIG. 2.

The tool bit 200, 300, 400, 500 further comprising a rear face 216, 316, 416, 516, a first side region 218, 318, 418, 518 extending from the second arcuate surface 208, 308, 408, 508 to the rear face 216, 316, 416, 516, and a second side region 220, 320, 420, 520 extending from the third arcuate surface 210, 310, 410, 510 to the rear face 216, 316, 416, 516. As shown in FIG. 4, the tool bit 300 may further comprising a fourth arcuate surface 330 extending circumferentially from the third arcuate surface 310, a fifth arcuate surface 332 extending circumferentially from the fourth arcuate surface 330, and a sixth arcuate surface 334 extending circumferentially from the fifth arcuate surface 332.

Referring again to FIGS. 3 thru 6, the working portion 204, 304, 404, 504 may define a free axial end 224, 324, 424, 524 and a notch 226, 326, 426, 526 disposed proximate the free axial end 224, 324, 424, 524. An insert 228, 328, 428, 528 disposed in the notch 226, 326, 426, 526.

The rear face 216, 316, 416, 516 defines a first draft angle β1 with the longitudinal axis L ranging from 0 to 40 degrees, the first side region 218, 318, 418, 518 defines a second draft angle β2 with the longitudinal axis L ranging from 0 to 40 degrees, the second side region 220, 320, 420, 520 defines a third draft angle β3 with the longitudinal axis L ranging from 0 to 40 degrees, and the first arcuate surface 206, 306, 406, 506, second arcuate surface 208, 308, 408, 508 and third arcuate surface 210, 310, 410, 510 define a fourth draft angle β4 with the longitudinal axis L ranging from 0 to 30 degrees. Each of the tool bits 200, 300, 400, 500 are symmetrical about the X-Z plane. Tool bit 400 has greater draft angles β1, β2, β3, β4 than tool bit 300. Tool bit 500 has greater drafter angles β1, β2, β3, β4 than tool bit 400.

The differences between the various tool bits 200, 300, 400, 500 of FIGS. 3 thru 6 will now be discussed. As mentioned previously the tool bit 300 of FIG. 4 has a greater angle of extension γ as compared to the tool bit 200 of FIG. 3. Also, the side regions 218, 220 of the tool bit 200 of FIG. 3 are slightly different configured than those of FIG. 4. The tool bit of FIG. 3 includes a top side transitional surface 230 connecting the second arcuate surface 208 to the top rear side surface 232. Both these surfaces 230, 232 transition downwardly along the negative Z axis to a bottom side surface 234. The tool bit 300 of FIG. 4 omits the bottom side surface but includes a top side transitional surface 338 and a top rear side surface 340. The differences may be at least partially attributed to providing suitable back support for the inserts 228, 328, which have predominantly angled flat surfaces 236, 342. The insert 328 in FIG. 4 has a depression 344, matching the depression 336 of the tool bit 300. Thus, the tool bit 200, 300 helps provide proper support to the insert 228, 328, thereby helping to prolong its useful life.

Figure 5:
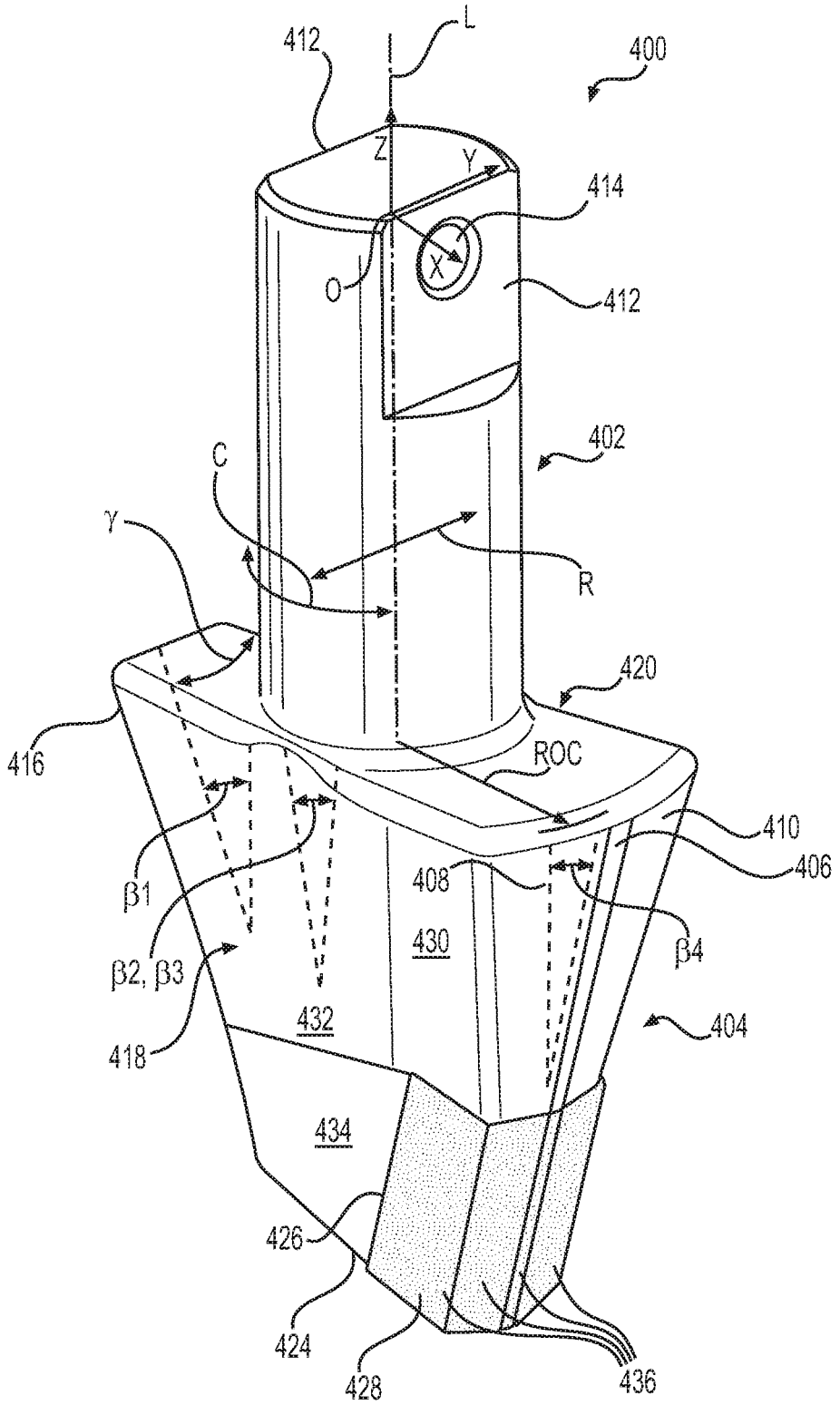
FIG. 5 is a perspective view of a third embodiment of the present disclosure showing a tool bit utilizing an arcuate bit face with more draft than the first embodiment of FIG. 3 that may be used in conjunction with the blade assembly of FIG. 2.
Figure 6:
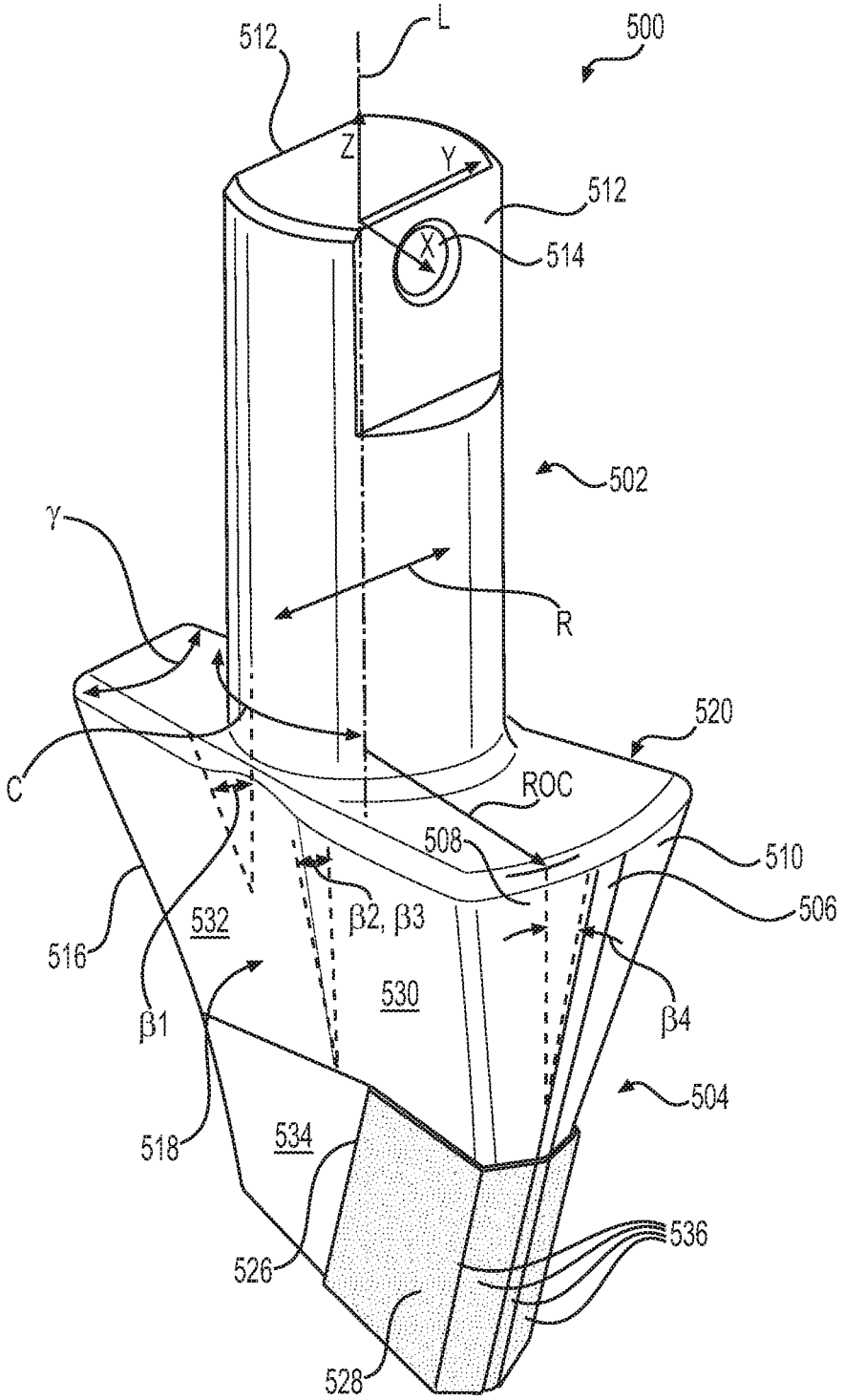
FIG. 6 is a perspective view of a fourth embodiment of the present disclosure showing a tool bit utilizing an arcuate bit face with more draft than the third embodiment of FIG. 5.
Figure 7:
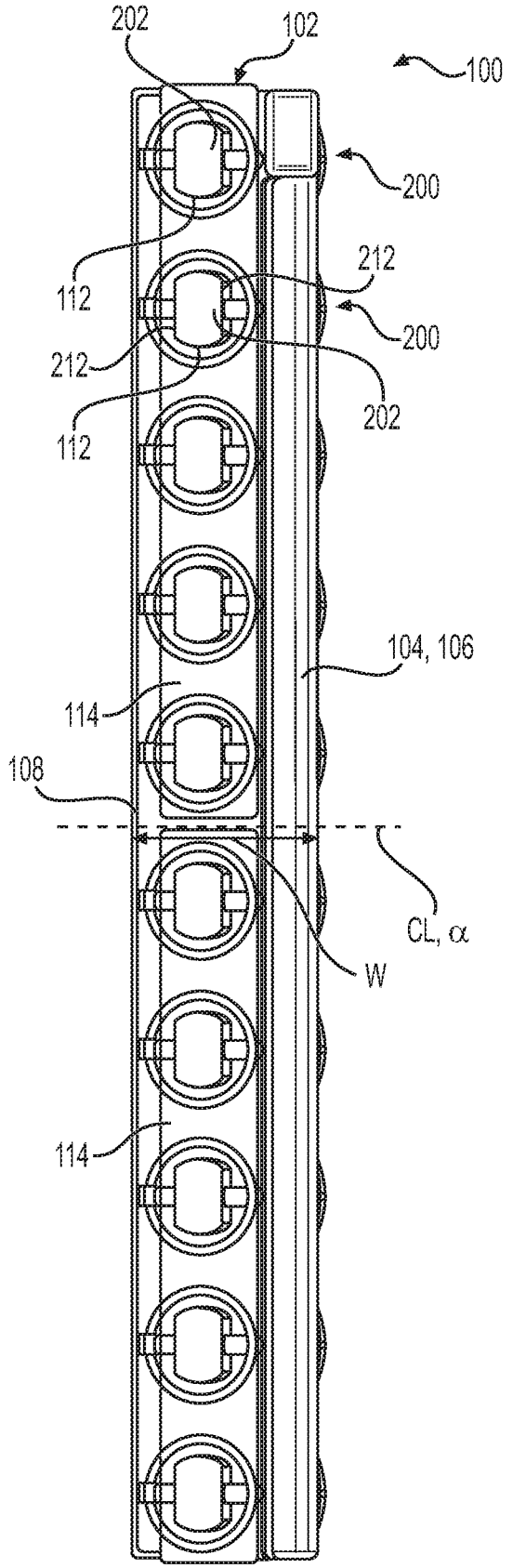
FIG. 7 is a top view of the blade assembly of FIG. 2 showing the tool bits arranged at a zero degree incline with respect to the centerline of the blade assembly.
Figure 8:
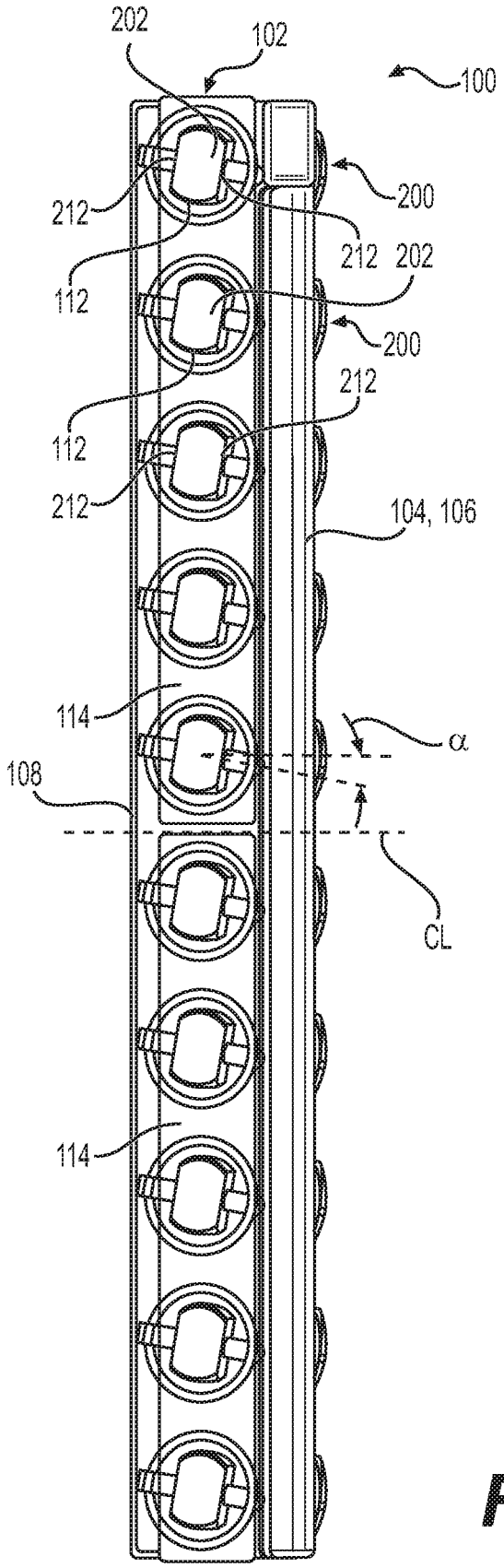
FIG. 8 is a top view of the blade assembly of FIG. 2 showing the tool bits arranged at a ten degree incline with respect to the centerline of the blade assembly.
Figure 9:
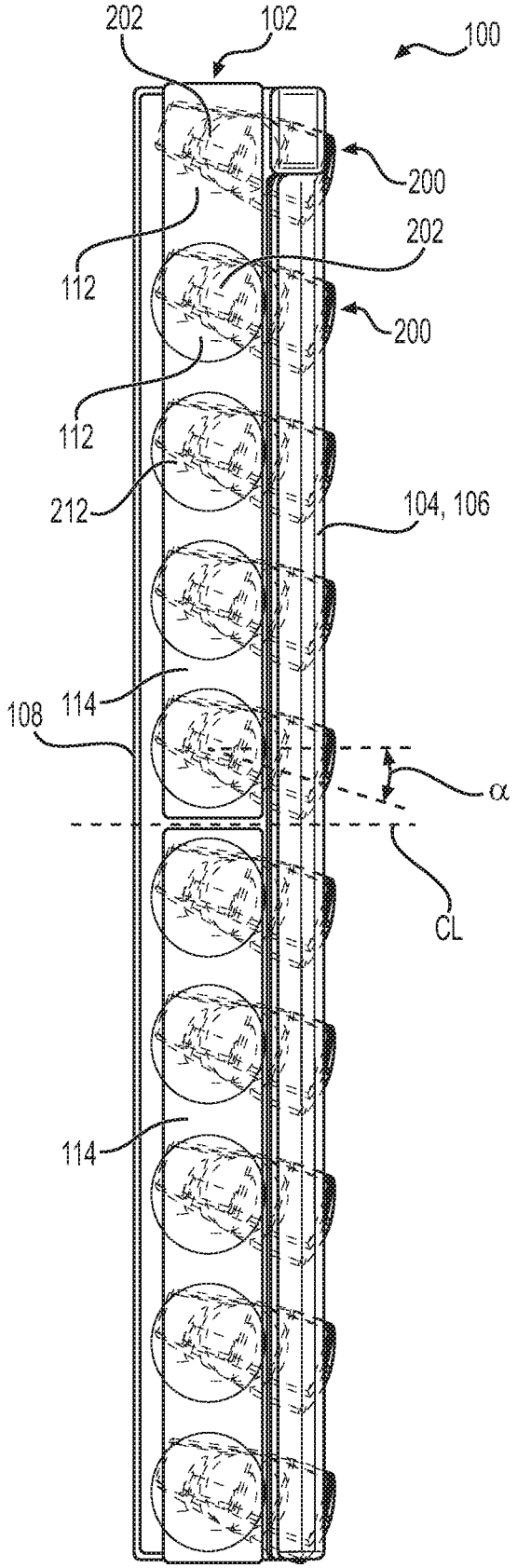
FIG. 9 is a top view of the blade assembly of FIG. 2 showing the tool bits arranged at a twenty degree incline with respect to the centerline of the blade assembly.
Figure 10:
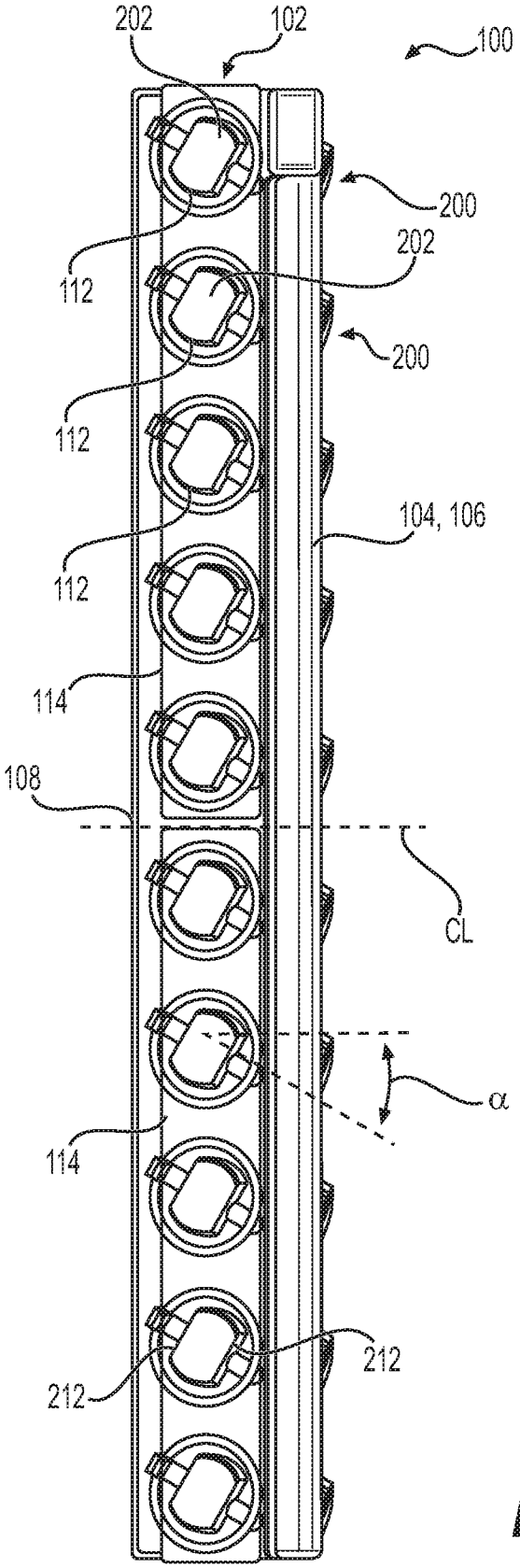
FIG. 10 is a top view of the blade assembly of FIG. 2 showing the tool bits arranged at a thirty degree incline with respect to the centerline of the blade assembly.

The tool bit 400 of FIG. 5 and the tool bit 500 of FIG. 6 have heavier draft angles β1, β2, β3, β4 than those of the tool bit 200 of FIG. 3, allowing the these tool bits 400, 500 to penetrate the ground or other work surface more easily than the tool bit 200 of FIG. 3. The tool bit 500 of FIG. 6 has a heavier draft angle β1, β2, β3, β4 than the tool bit 400 of FIG. 5 for similar reasons. The side regions 418, 420, 518, 520 of these tool bits 400, 500 also have a top side transitional surface 430, 530 a top rear side surface 432, 532 and a bottom side surface 434, 534 for the same reasons just discussed. Also, the inserts 428, 528 comprise predominately angled flat surfaces 436, 536. This may not the case for other embodiments of the present disclosure. The inserts for any embodiment may be symmetrical about the X-Z plane.

Additional drafted tool bits will now be described with reference to FIGS. 11 thru 46. It is to be understood that various features of the tool bits of FIGS. 11 thru 16 may have arcuate surfaces such as disclosed in FIGS. 3 thru 6. Likewise, the tool bits of FIGS. 3 thru 6, may have the features such as the drafted surfaces, dimensions, angles, etc. as will now be described with reference to FIGS. 11 thru 46.

Figure 11:
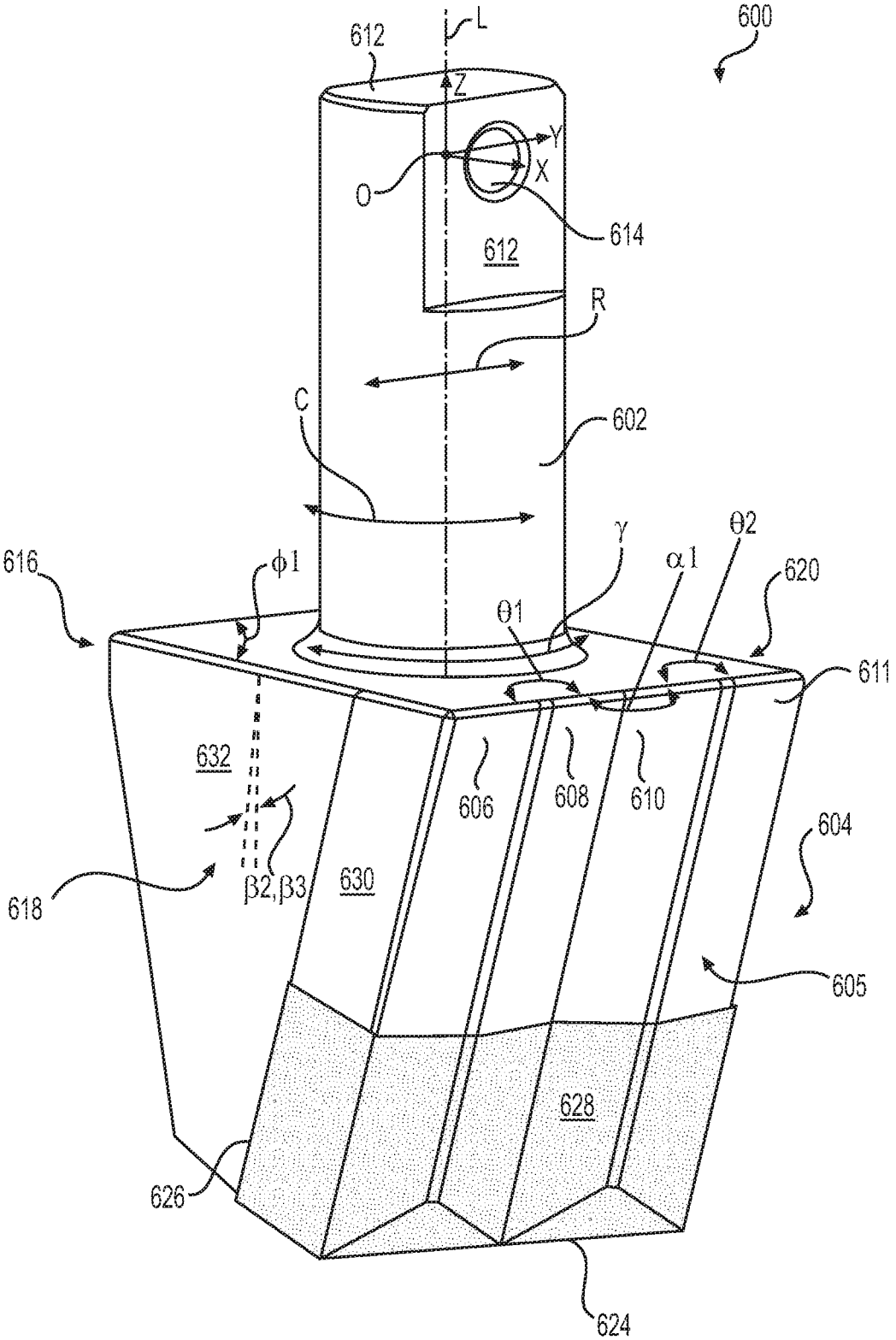
FIG. 11 is a perspective view of a wide grader tool bit that is drafted for reducing drag of the ground or other work surface, lacking arcuate surfaces.
Figure 12:
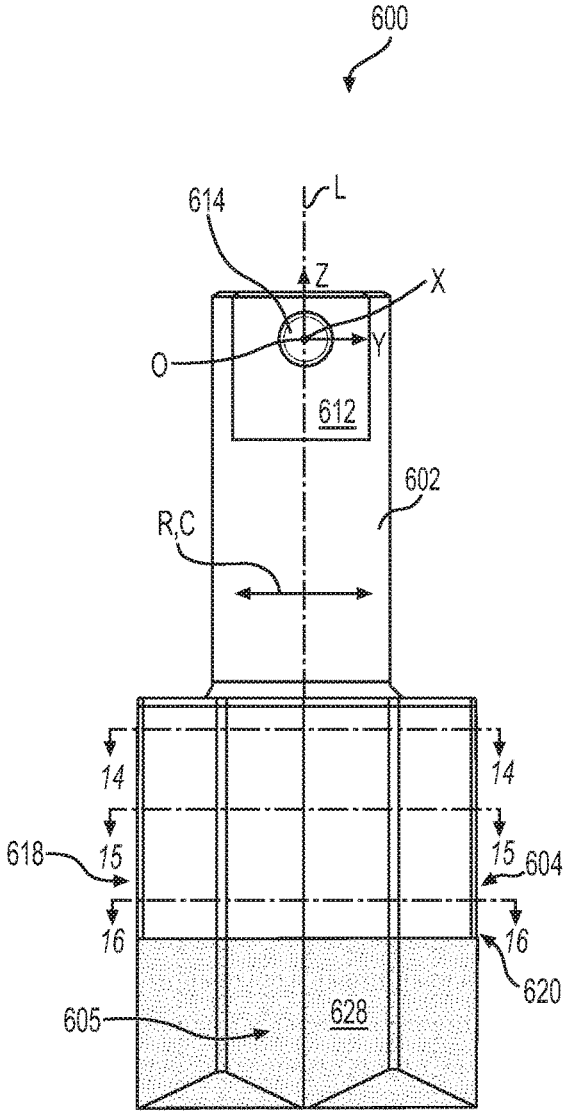
FIG. 12 is a front view of the wide grader tool bit of FIG. 11.
Figure 17:
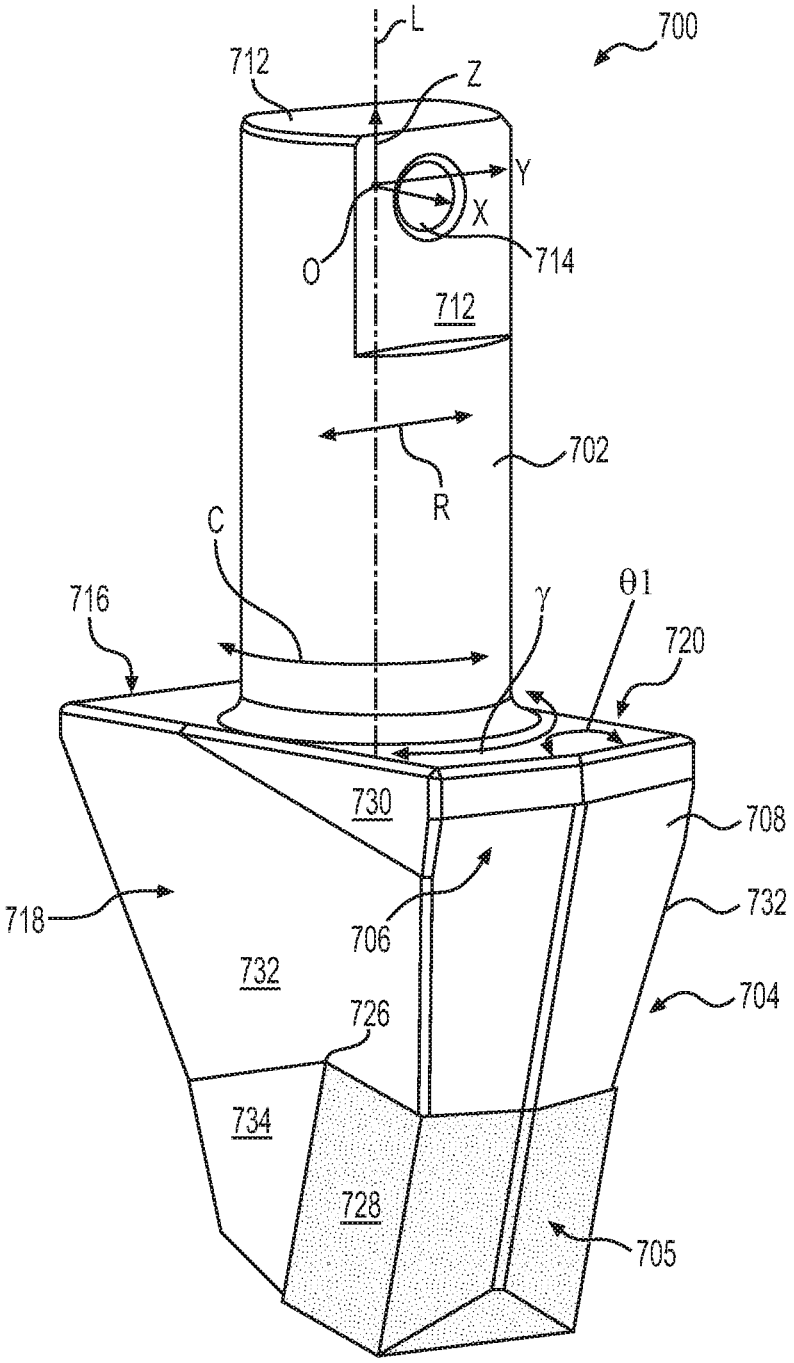
FIG. 17 is a perspective view of a standard grader tool bit that is more heavily drafted than the tool bit of FIG. 11, helping to penetrate the ground or other work surface, and also lacking arcuate surfaces.
Figure 23:
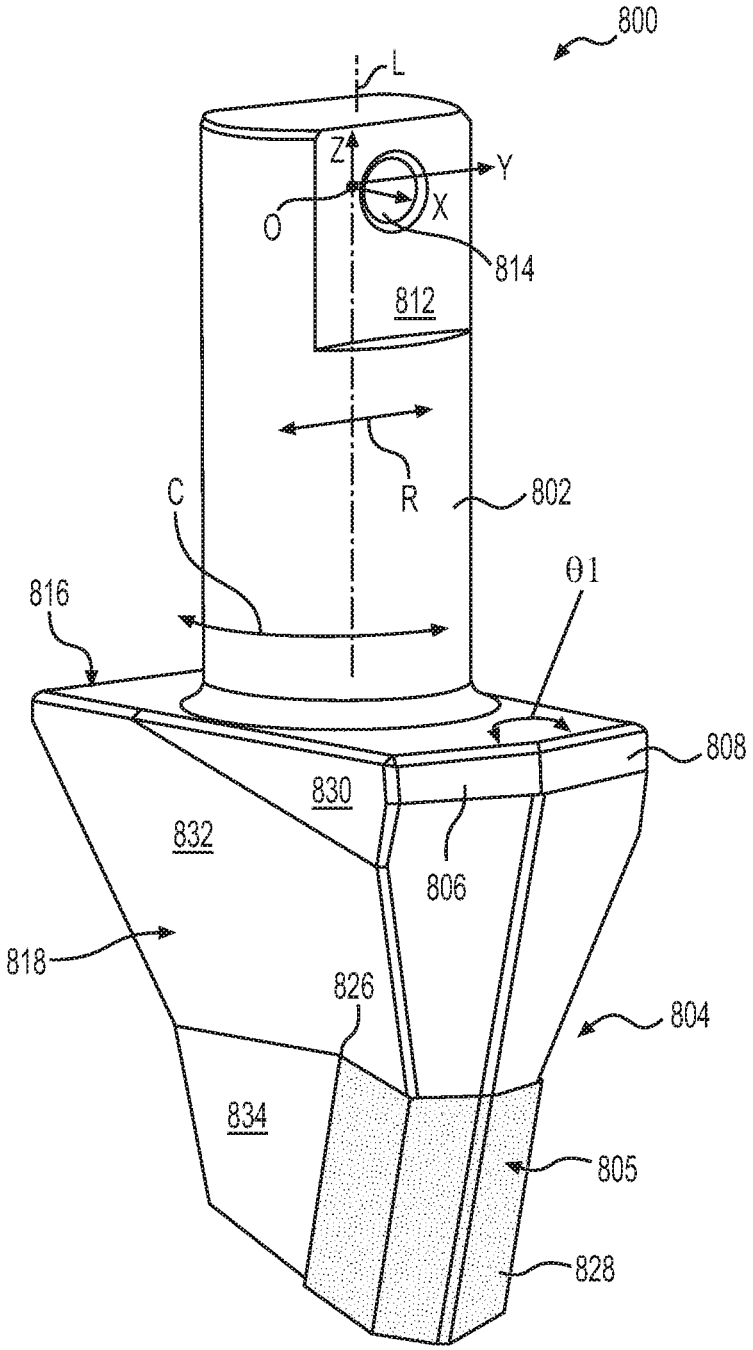
FIG. 23 is a perspective view of a sharp grader tool bit that is more heavily drafted than the tool bit of FIG. 17, helping to penetrate the ground or other work surface, and also lacking arcuate surfaces.
Figure 29:
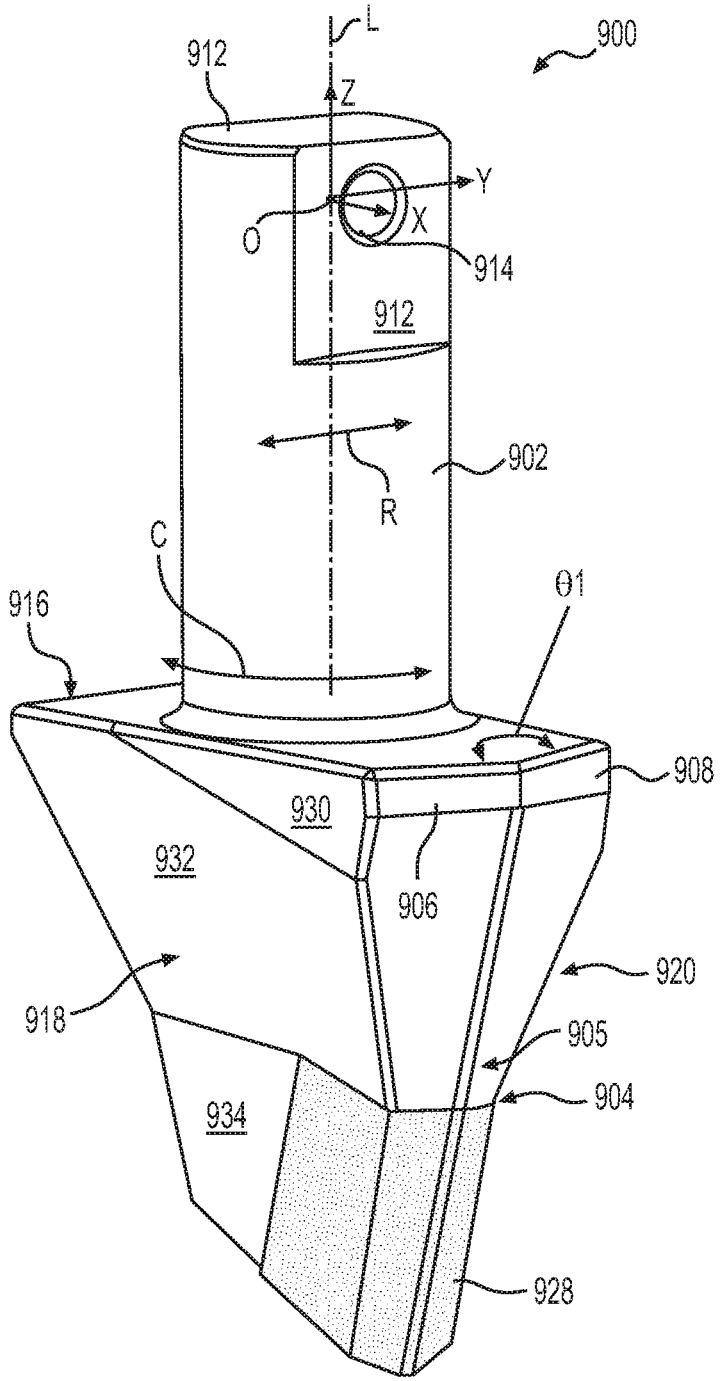
FIG. 29 is a perspective view of a penetration grader tool bit that is more heavily drafted than the tool bit of FIG. 23, helping to penetrate the ground or other work surface, and also lacking arcuate surfaces.

Specifically, in FIGS. 3 and 17, surface 230 may be similarly constructed as surface 730, surface 232 may be similarly constructed as surface 732, and surface 234 may be similarly constructed as surface 734. In FIGS. 4 and 11, surface 338 may be similarly constructed as surface 630, and surface 340 may be similarly constructed as surface 632, etc. In FIGS. 5 and 23, surface 430 and surface 830 may be similarly constructed. Surface 432 and surface 832 may be similarly constructed and surface 434 and surface 734 may be similarly constructed, etc. In FIGS. 6 and 29, surface 530 and surface 930, surface 532 and surface 932, and surface 534 and surface 934 may be similarly, constructed, etc.

Looking at FIGS. 11 thru 16, a tool bit 600 (e.g. a wide grading tool bit) for use with a blade assembly 100 of a grading machine 10 is illustrated. The tool bit 600 comprises a shank portion 602 defining a longitudinal axis L, and a working portion 604. The working portion 604 includes a rear region 616, a front working region 605, a first side region 618 and a second side region 620, and the first side region 618 and the second side region 620 may define an angle of extension γ measured in a plane perpendicular to the longitudinal axis L, forming a wider front working region 605 than the rear region 616 in a plane perpendicular to the longitudinal axis L. The angle of extension γ may range from 0 to 20 degrees. The front working region 605 is so called since this region that predominantly performs the work when contacting or penetrating the ground or other work surface.

The shank portion 602 may include a cylindrical configuration defining a circumferential direction C and a radial direction R. The rear region 616 may at least partially form a right angle RA with the radial direction R in a plane perpendicular to the longitudinal axis L (best seen in FIGS. 14 thru 16).

The front working region 605 may include a first angled surface 606 and a second angled surface 608 forming a first included angle Θ1 with the first angled surface 606 projected along the longitudinal axis L onto a plane perpendicular to the longitudinal axis L ranging from 150 to 180 degrees. Similarly, the front working region 605 may further comprise a third angled surface 610 forming a first external angle α1 with the second angled surface 608 projected along the longitudinal axis L onto a plane perpendicular to the longitudinal axis L ranging from 150 to 180 degrees. Likewise, the front working region 605 further comprises a fourth angled surface 611 forming a second included angle Θ2 with the third angled surface 610 projected along the longitudinal axis L onto a plane perpendicular to the longitudinal axis L ranging from 150 to 180 degrees.

The first side region 618 or second side region 620 may include a first drafted side surface 632 configured to reduce drag of the tool bit 600 along the longitudinal axis L in use. For the embodiment shown in FIGS. 11 and 16, this surface may have little to no draft (e.g. 0 to 5 degrees). In many embodiments such as that shown in FIGS. 11 thru 16, the tool bit 600 is symmetrical about an X-Z plane of a Cartesian coordinate system with its origin O on the longitudinal axis L and its X-axis aligned with the cross-hole 614 passing through the flat surfaces 612 of the shank portion 602.

Figure 13:
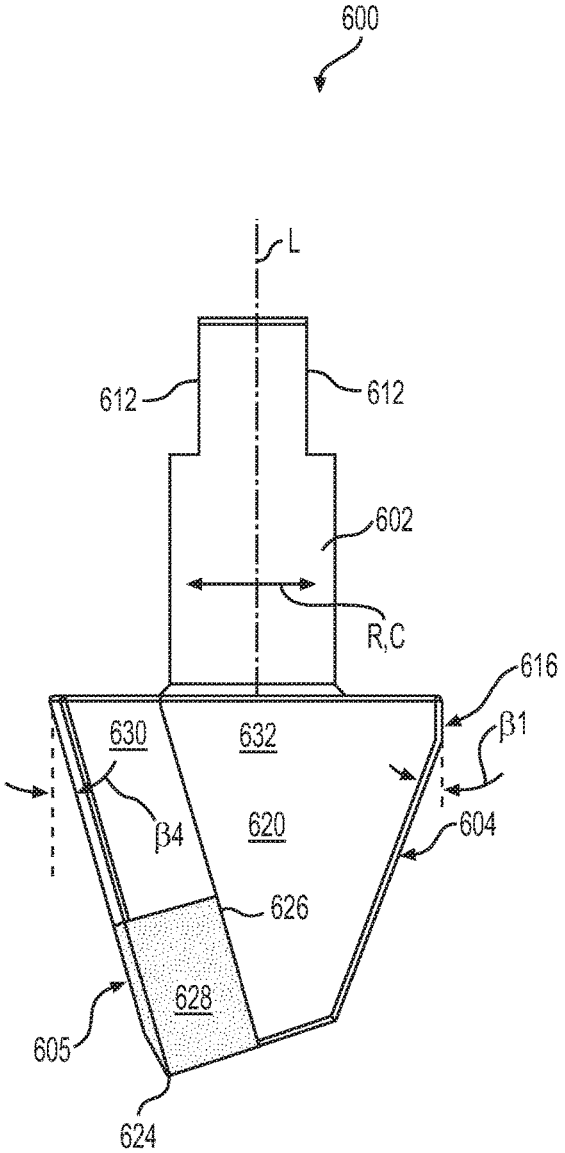
FIG. 13 is a side view of the wide grader tool bit of FIG. 11.

Referring to FIGS. 11 and 13, the rear region 616 may form a first draft angle β1 with the longitudinal axis L measured in a plane containing the radial direction R and the longitudinal axis L, the first draft angle β1 ranging from 0 to 20 degrees. The first side region 618 may form a second draft angle β2 with the longitudinal axis L measured in a plane containing the radial direction R and the longitudinal axis L, ranging from 0 to 30 degrees. The second side region 620 may form a third draft angle β3 with the longitudinal axis L measured in a plane containing the radial direction R and the longitudinal axis L, ranging from 0 to 30 degrees. The front working region 605 may form a fourth draft angle β4 with the longitudinal axis L measured in a plane containing the radial direction R and the longitudinal axis L, ranging from 0 to 30 degrees. β2 and β3 are negative draft angles as seen in FIGS. 14 thru 15 since the width of the cross-section of the working portion 604 is decreasing as one progresses upwardly along the longitudinal axis L.

This tool bit 600 may be further describe as follows with reference to FIGS. 11 thru 16. A tool bit 600 for use with a blade assembly 100 of a grading machine 10 may comprise a shank portion 602 defining a longitudinal axis L, and a working portion 604. The working portion 604 includes a rear region 616, a front working region 605, a first side region 618 and a second side region 620, and the first side region 618 or the second side region 620 include a first vertical surface 630 disposed longitudinally adjacent the shank portion 602, and a first drafted side surface 632 configured to reduce drag of the tool bit 600 into the ground or other work surface extending from the first vertical surface 630.

The first drafted side surface 632 may extend downwardly longitudinally from or past the first vertical surface 630 and the working portion 605 and terminate at the free axial end 624 of the tool bit 600. The first drafted surface 632 forms at least partially a first obtuse included angle φ1 with the rear region 616 projected along the longitudinal axis L onto a plane perpendicular to the longitudinal axis L, ranging from 90 to 120 degrees. The first drafted side surface 632 and the first vertical surface 630 may at least partially border a notch 626 configured to receive an insert 628.

Figure 16:
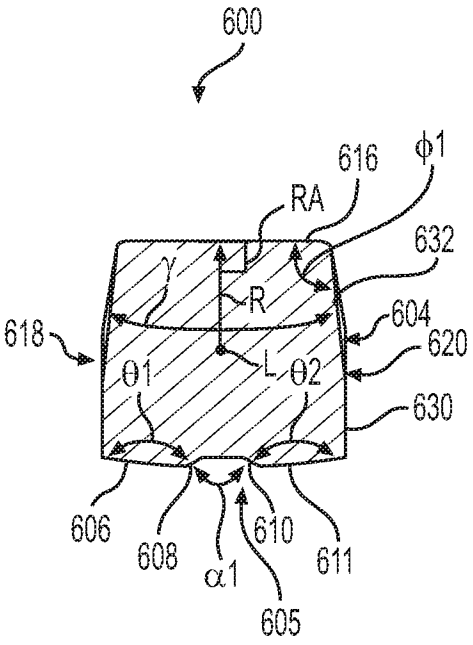
FIG. 16 is a cross-section of the wide grader tool bit of FIG. 12 taken along lines 16-16 thereof.
Figure 15:
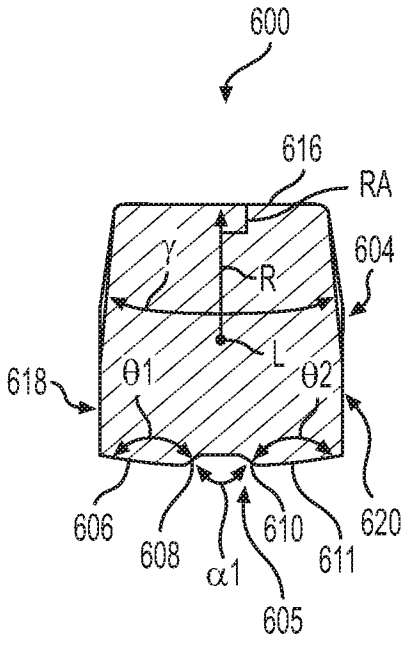
FIG. 15 is a cross-section of the wide grader tool bit of FIG. 12 taken along lines 15-15 thereof.
Figure 14:
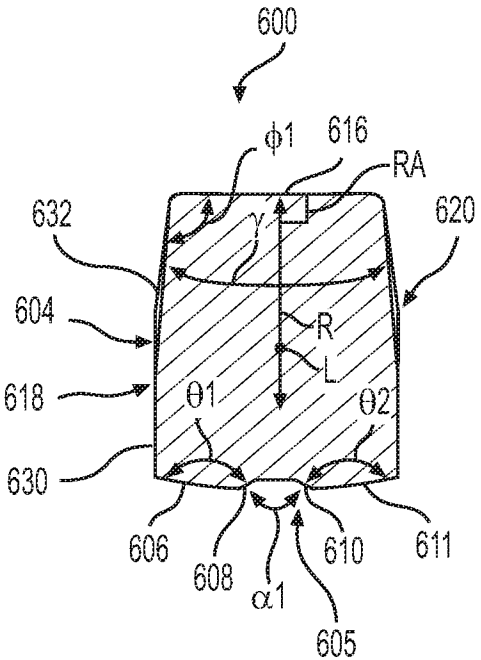
FIG. 14 is a cross-section of the wide grader tool bit of FIG. 12 taken along lines 14-14 thereof.

FIGS. 14 thru 16 show how the cross-section of the tool bit 600 changes over time as the tool bit wears. FIG. 16 shows a first state of initial wear. FIG. 15 shows an intermediate state of wear while FIG. 14 shows an advanced state of wear. Polygonal cross-sections, such as nearly trapezoidal cross-sections, are formed.

FIGS. 17 thru 22 depict a standard grading tool bit. This tool bit is similarly configured as the tool bit of FIGS. 11 thru 16. The tool bit 700 comprises a shank portion 702 defining a longitudinal axis L, and a working portion 704 extending downwardly axially from the shank portion 702. The working portion 704 includes a rear region 716, a front working region 705, a first side region 718 and a second side region 720, and the first side region 718 and the second side region 720 may define an angle of extension γ measured in a plane perpendicular to the longitudinal axis L, forming a wider front working region 705 than the rear region 716 in a plane perpendicular to the longitudinal axis. The angle of extension γ may range from 0 to 40 degrees.

Figure 20:
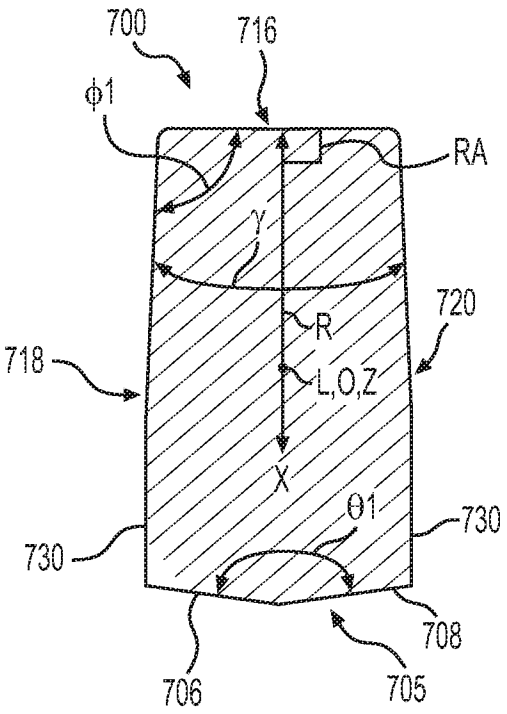
FIG. 20 is a cross-section of the standard grader tool bit of FIG. 18 taken along lines 20-20 thereof.
Figure 21:
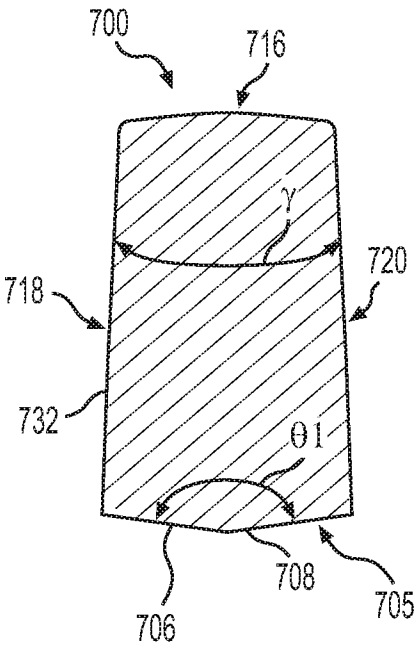
FIG. 21 is a cross-section of the standard grader tool bit of FIG. 18 taken along lines 21-21 thereof.
Figure 22:
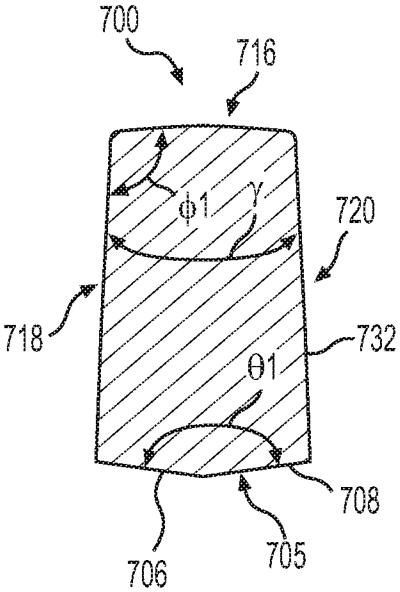
FIG. 22 is a cross-section of the standard grader tool bit of FIG. 18 taken along lines 22-22 thereof.

The shank portion 702 may include a cylindrical configuration defining a circumferential direction C and a radial direction R and the rear region 716 may at least partially form a right angle RA with the radial direction R in a plane perpendicular to the longitudinal axis L (best seen in FIGS. 20 thru 22).

The front working region 705 may include a first angled surface 706 and a second angled surface 708 forming a first included angle Θ1 with the first angled surface 706 projected along the longitudinal axis L onto a plane perpendicular to the longitudinal axis, ranging from 130 to 180 degrees. The first side region 718 or second side region 720 may include a first drafted side surface 732 configured to improve penetration of the tool bit 700 in use. In many embodiments such as that shown in FIGS. 17 thru 22, the tool bit 700 is symmetrical about an X-Z plane about a Cartesian coordinate system with its origin O on the longitudinal axis L and its X-axis aligned with the cross-hole 714 passing through the flat surfaces 712.

Figure 18:
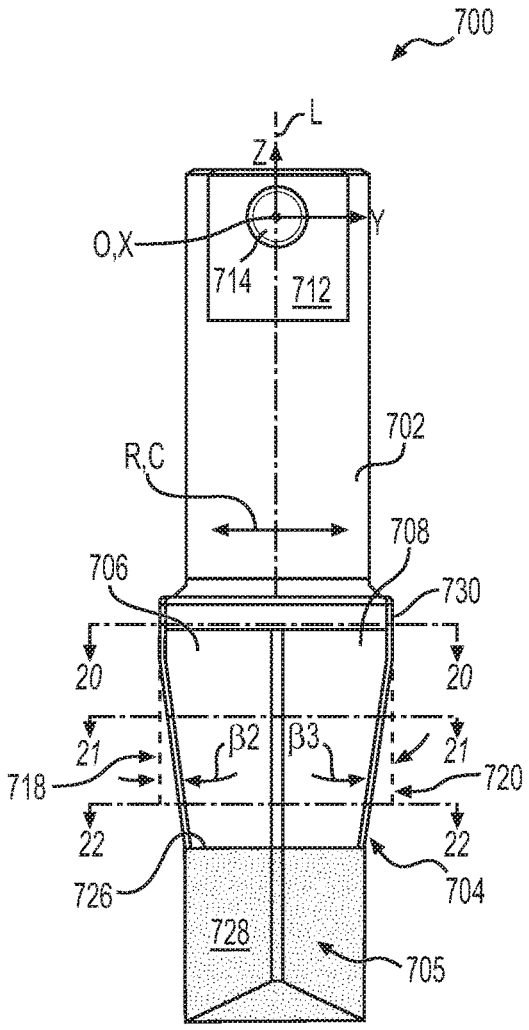
FIG. 18 is a front view of the standard grader tool bit of FIG. 17.
Figure 19:
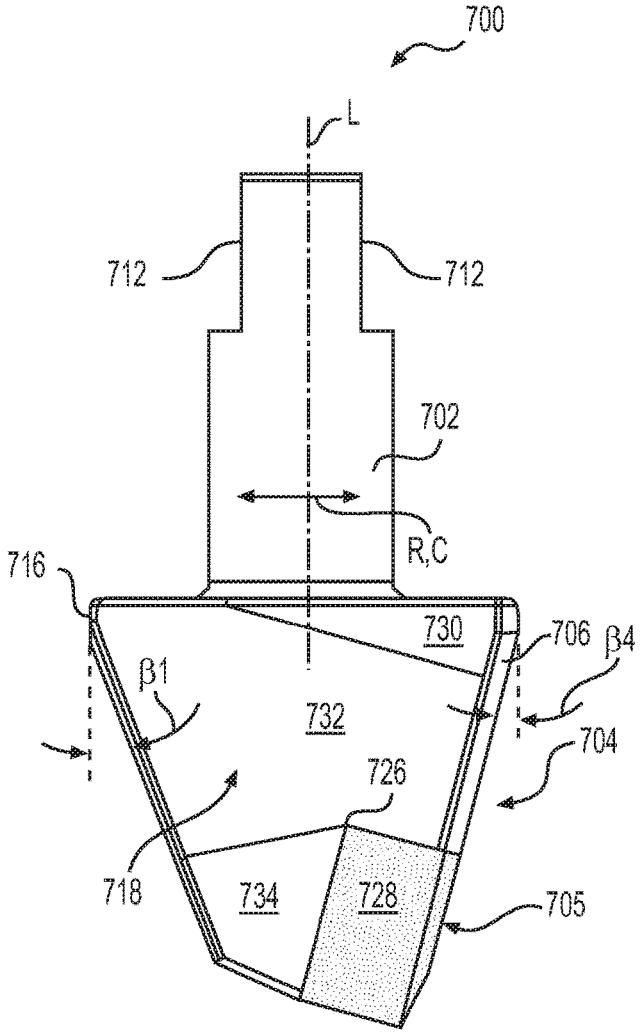
FIG. 19 is a side view of the standard grader tool bit of FIG. 17.

As shown in FIG. 19, the rear region 716 may form a first draft angle β1 with the longitudinal axis L measured in a plane containing the radial direction R and longitudinal axis L, the first draft angle β1 ranging from 0 to 35 degrees. Similarly, as shown in FIG. 18, the first side region may form a second draft angle β1 with the longitudinal axis L measured in a plane containing the radial direction R and longitudinal axis L, forming a second draft angle β2, ranging from 0 to 40 degrees. The second side region 720 may form a third draft angle β3 with the longitudinal axis L measured in a plane containing the radial direction R and the longitudinal axis L, ranging from 0 to 40 degrees. Returning to FIG. 19, the front working region 705 may form a fourth draft angle β4 with the longitudinal axis L measured in a plane containing the radial direction R and the longitudinal axis L, ranging from 0 to 30 degrees. β2 and β3 are positive draft angles as seen in FIGS. 20 thru 15 since the width of the cross-section of the working portion 704 is increasing as one progresses upwardly along the longitudinal axis L.

This tool bit 700 may be further describe as follows with reference to FIGS. 17 thru 22. A tool bit 700 for use with a blade assembly 100 of a grading machine 10 may comprise a shank portion 702 defining a longitudinal axis L, and a working portion 704. The working portion 704 includes a rear region 716, a front working region 705, a first side region 718 and a second side region 720, and the first side region 718 or the second side region 720 includes a first vertical surface 730 disposed longitudinally adjacent the shank portion 702, and a first drafted side surface 732 configured to improve penetration of the tool bit 700 extending from the first vertical surface 730.

The first drafted side surface 732 may extend downwardly longitudinally from the first vertical surface 730 and the working portion 705 may include a second vertical surface 734 extending downwardly longitudinally from the first drafted side surface 732. The first drafted side surface 732 forms at least partially a first included obtuse angle φ1 with the rear region 716 projected along the longitudinal axis L onto a plane perpendicular to the longitudinal axis L. The first drafted side surface 732 and the second vertical surface 734 may at least partially border a notch 726 configured to receive an insert 728.

FIGS. 20 thru 22 show how the cross-section of the tool bit 700 changes over time as the tool bit 700 wears. FIG. 22 shows a first state of initial wear. FIG. 21 shows an intermediate state of wear while FIG. 20 shows an advanced state of wear. Polygonal cross-sections, such nearly trapezoidal cross-sections, are formed.

FIGS. 23 thru 28 depict a sharp grader tool bit. This tool bit is similarly configured as the tool bit of FIGS. 17 thru 22, but with more draft, etc. The tool bit 800 comprises a shank portion 802 defining a longitudinal axis L, and a working portion 804 extending downwardly axially from the shank portion 802. The working portion 804 includes a rear region 816, a front working region 805, a first side region 818 and a second side region 820, and the first side region 818 and the second side region 820 may define an angle of extension γ measured in a plane perpendicular to the longitudinal axis L, forming a wider front working region 805 than the rear region 816 in a plane perpendicular to the longitudinal axis. The angle of extension γ may range from 0 to 50 degrees.

The shank portion 802 may include a cylindrical configuration defining a circumferential direction C and a radial direction R and the rear region 816 may at least partially form a right angle RA with the radial direction R in a plane perpendicular to the longitudinal axis L (best seen in FIG. 20).

The front working region 805 may include a first angled surface 806 and a second angled surface 808 forming a first included angle Θ1 with the first angled surface 806 projected along the longitudinal axis L onto a plane perpendicular to the longitudinal axis, ranging from 140 to 180 degrees. The first side region 818 or second side region 820 may include a first drafted side surface 832 configured to improve penetration of the tool bit 800 in use. In many embodiments such as that shown in FIGS. 23 thru 28, the tool bit 800 is symmetrical about an X-Z plane about a Cartesian coordinate system with its origin O on the longitudinal axis L and its X-axis aligned with the cross-hole 814 passing through the flat surfaces 812.

Figure 24:
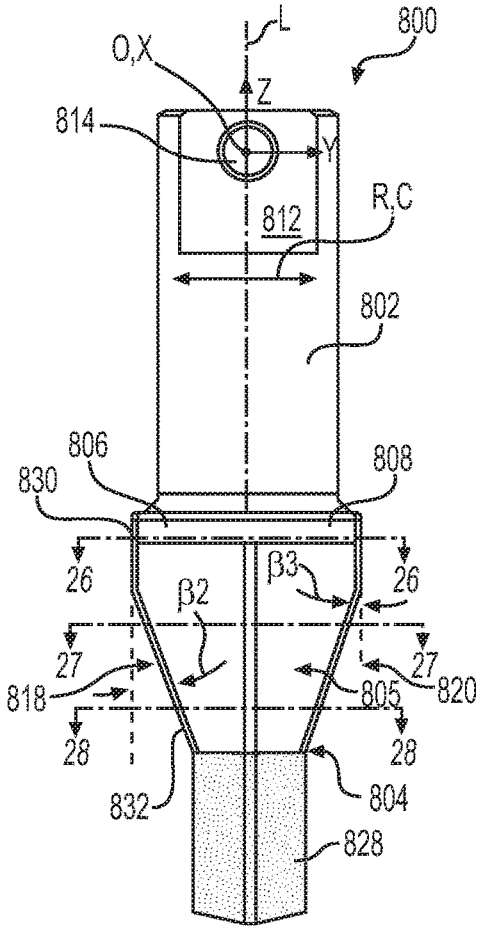
FIG. 24 is a front view of the sharp grader tool bit of FIG. 23.
Figure 25:
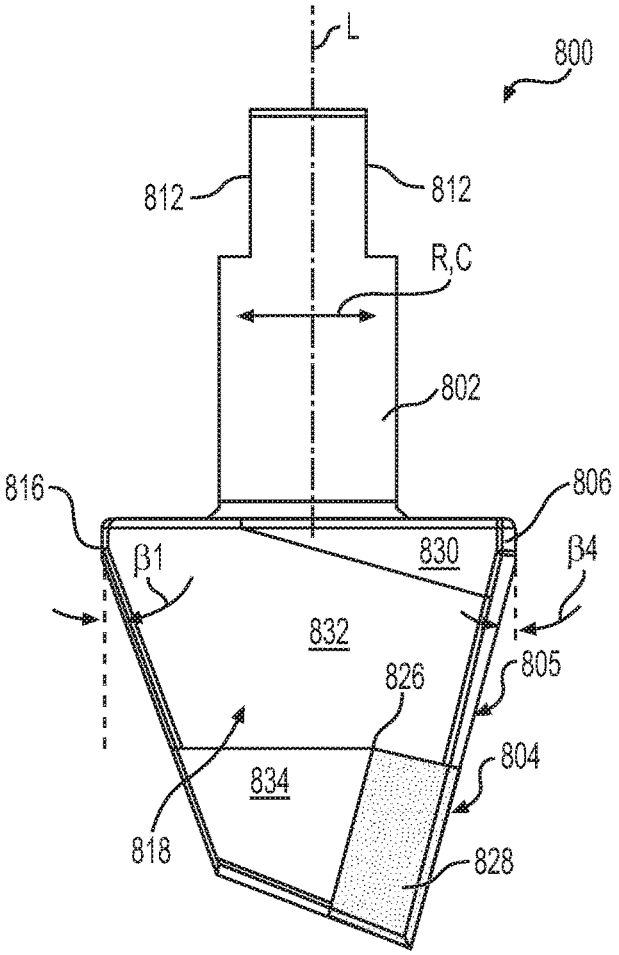
FIG. 25 is a side view of the sharp grader tool bit of FIG. 23.

As shown in FIG. 25, the rear region 816 may form a first draft angle β1 with the longitudinal axis L measured in a plane containing the radial direction R and longitudinal axis L, the first draft angle β1 ranging from 0 to 30 degrees. Similarly, as shown in FIG. 24, the first side region 818 may form a second draft angle β2 with the longitudinal axis L measured in a plane containing the radial direction R and longitudinal axis L, ranging from 0 to 40 degrees. The second side region 820 may form a third draft angle β3 with the longitudinal axis L measured in a plane containing the radial direction R and the longitudinal axis L, ranging from 0 to 40 degrees. Returning to FIG. 25, the front working region 805 may form a fourth draft angle β4 with the longitudinal axis L measured in a plane containing the radial direction R and the longitudinal axis L, ranging from 0 to 30 degrees. β2 and β3 are positive draft angles as seen in FIGS. 26 thru 28 since the width of the cross-section of the working portion 804 is increasing as one progresses upwardly along the longitudinal axis L.

This tool bit 800 may be further describe as follows with reference to FIGS. 23 thru 28. A tool bit 800 for use with a blade assembly 100 of a grading machine 10 may comprise a shank portion 802 defining a longitudinal axis L, and a working portion 804. The working portion 804 includes a rear region 816, a front working region 805, a first side region 818 and a second side region 820, and the first side region 818 or the second side region 820 includes a first vertical surface 830 disposed longitudinally adjacent the shank portion 802, and a first drafted side surface 832 configured to improve penetration of the tool bit 800 extending from the first vertical surface 830.

The first drafted side surface 832 may extend downwardly longitudinally from the first vertical surface 830. The working portion 805 may include a second vertical surface 834 extending downwardly longitudinally from the first drafted side surface 832. The first drafted side surface 832 forms at least partially a first included obtuse angle φ1 with the rear region 816 projected along the longitudinal axis L onto a plane perpendicular to the longitudinal axis L. The first drafted side surface 832 and the second vertical surface 834 may at least partially border a notch 826 configured to receive an insert 828.

Figure 28:
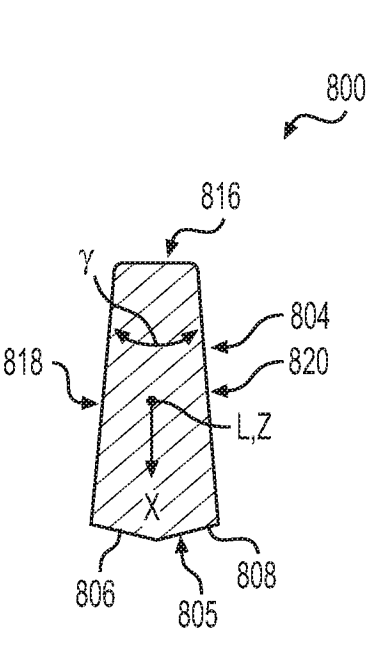
FIG. 28 is a cross-section of the sharp grader tool bit of FIG. 24 taken along lines 28-28 thereof.
Figure 27:
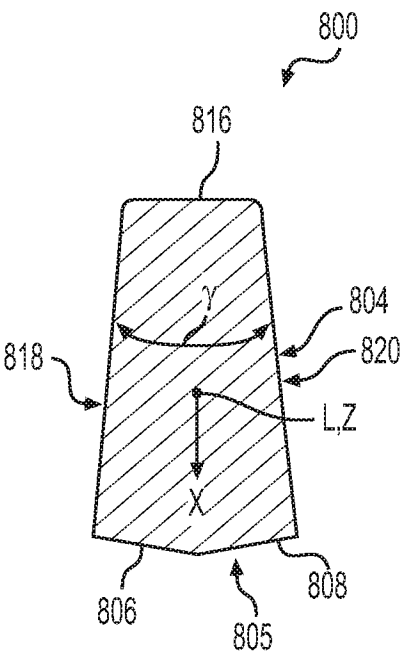
FIG. 27 is a cross-section of the sharp grader tool bit of FIG. 24 taken along lines 27-27 thereof.
Figure 26:
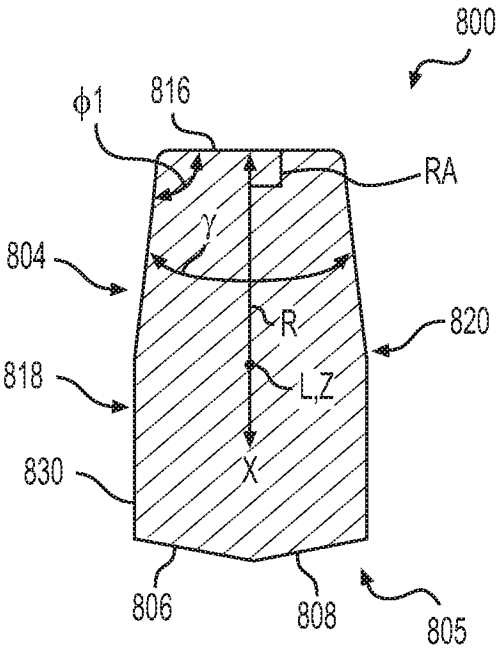
FIG. 26 is a cross-section of the sharp grader tool bit of FIG. 24 taken along lines 26-26 thereof.

FIGS. 26 thru 28 show how the cross-section of the tool bit 800 changes over time as the tool bit 800 wears. FIG. 28 shows a first state of initial wear. FIG. 27 shows an intermediate state of wear while FIG. 26 shows an advanced state of wear. Polygonal cross-sections, such nearly trapezoidal cross-sections, are formed.

FIGS. 29 thru 34 depict a penetration grader tool bit. This tool bit is similarly configured as the tool bit of FIGS. 17 thru 22, but with more draft, etc. The tool bit 900 comprises a shank portion 902 defining a longitudinal axis L, and a working portion 904 extending downwardly axially from the shank portion 902. The working portion 904 includes a rear region 916, a front working region 905, a first side region 918 and a second side region 920, and the first side region 918 and the second side region 920 may define an angle of extension γ measured in a plane perpendicular to the longitudinal axis L, forming a wider front working region 905 than the rear region 916 in a plane perpendicular to the longitudinal axis L. The angle of extension γ may range from 0 to 40 degrees.

Figure 32:
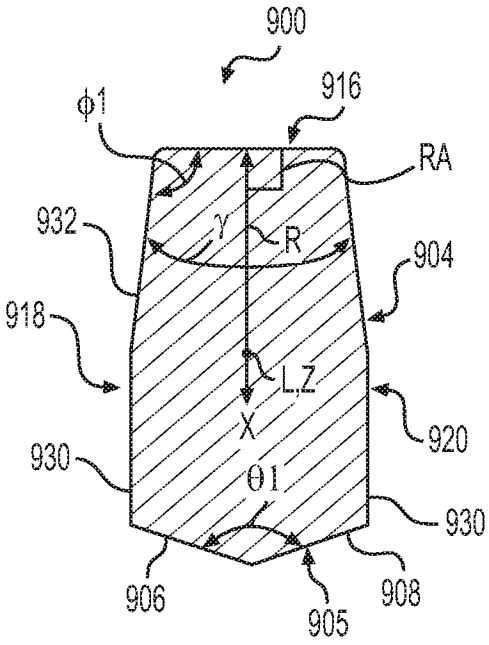
FIG. 32 is a cross-section of the penetration grader tool bit of FIG. 30 taken along lines 32-32 thereof.

The shank portion 902 may include a cylindrical configuration defining a circumferential direction C and a radial direction R and the rear region 916 may at least partially form a right angle RA with the radial direction R in a plane perpendicular to the longitudinal axis L (best seen in FIG. 32).

The front working region 905 may include a first angled surface 906 and a second angled surface 908 forming a first included angle Θ1 with the first angled surface 906 projected along the longitudinal axis L onto a plane perpendicular to the longitudinal axis L, ranging from 130 to 180 degrees. The first side region 918 or second side region 920 may include a first drafted side surface 932 configured to improve penetration of the tool bit 900 in use. In many embodiments such as that shown in FIGS. 29 thru 34, the tool bit 900 is symmetrical about an X-Z plane about a Cartesian coordinate system with its origin O on the longitudinal axis L and its X-axis aligned with the cross-hole 914 passing through the flat surfaces 912.

Figure 30:
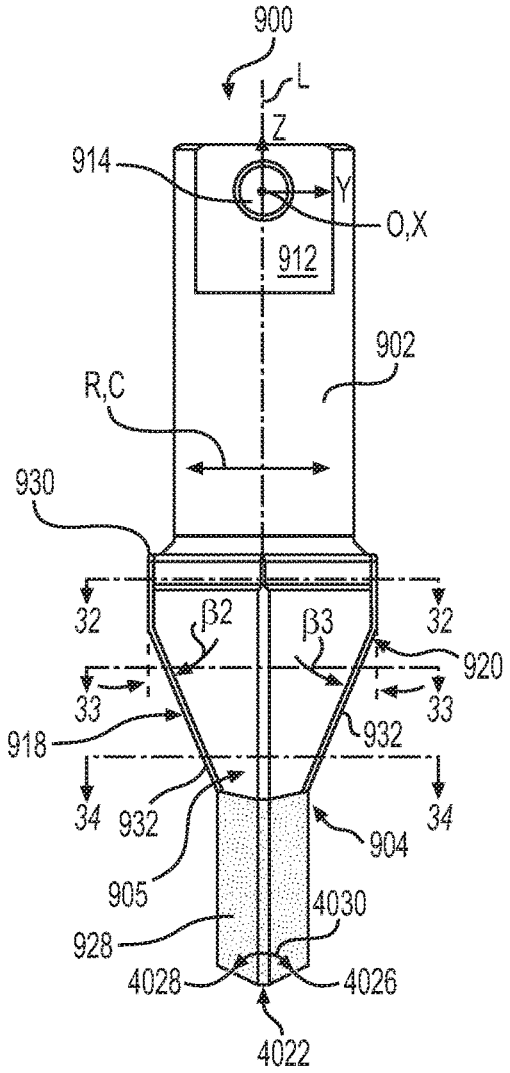
FIG. 30 is a front view of the penetration grader tool bit of FIG. 29.
Figure 31:
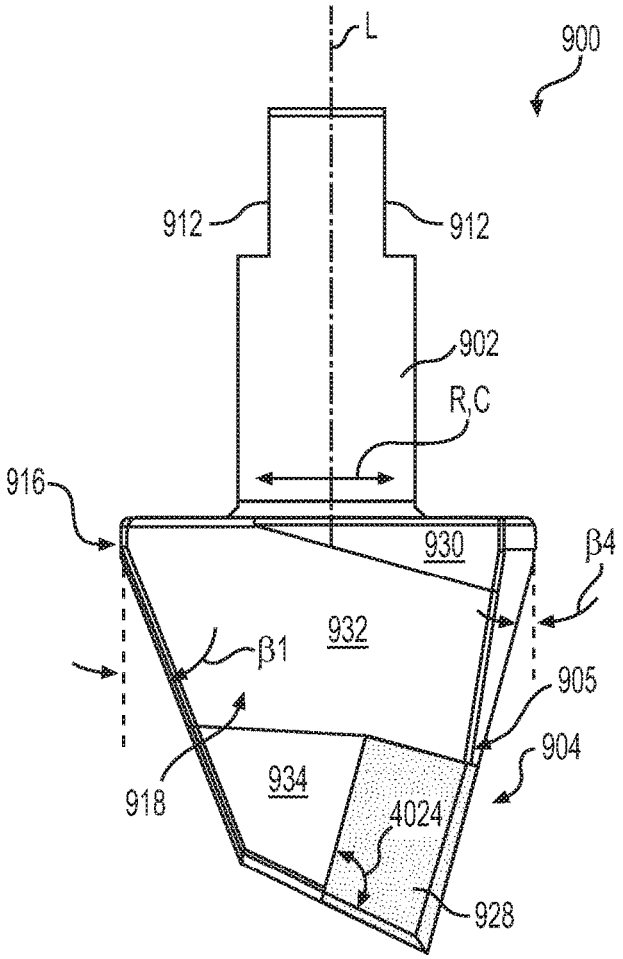
FIG. 31 is a side view of the penetration grader tool bit of FIG. 29.

As shown in FIG. 31, the rear region 916 may form a first draft angle β1 with the longitudinal axis L measured in a plane containing the radial direction R and longitudinal axis L, the first draft angle β1 ranging from 0 to 30 degrees. Similarly, as shown in FIG. 30, the first side region 918 may form a second draft angle β2 with the longitudinal axis L measured in a plane containing the radial direction R and longitudinal axis L, ranging from 0 to 45 degrees. The second side region 920 may form a third draft angle β3 with the longitudinal axis L measured in a plane containing the radial direction R and the longitudinal axis L, ranging from 0 to 45 degrees. Returning to FIG. 31, the front working region 905 may form a fourth draft angle β4 with the longitudinal axis L measured in a plane containing the radial direction R and the longitudinal axis L, ranging from 0 to 30 degrees. β2 and β3 are positive draft angles as seen in FIGS. 32 thru 34 since the width of the cross-section of the working portion 904 is increasing as one progresses upwardly along the longitudinal axis L.

This tool bit 900 may be further describe as follows with reference to FIGS. 29 thru 34. A tool bit 900 for use with a blade assembly 100 of a grading machine 10 may comprise a shank portion 902 defining a longitudinal axis L, and a working portion 904. The working portion 904 includes a rear region 916, a front working region 905, a first side region 918 and a second side region 920, and the first side region 918 or the second side region 920 includes a first vertical surface 930 disposed longitudinally adjacent the shank portion 902, and a first drafted side surface 932 configured to improve penetration of the tool bit 900 extending from the first vertical surface 930.

The first drafted side surface 932 may extend downwardly longitudinally from the first vertical surface 930. The working portion 905 may include a second vertical surface 934 extending downwardly longitudinally from the first drafted side surface 932. The first drafted side surface 932 forms at least partially a first included obtuse angle φ1 with the rear region 916 projected along the longitudinal axis L onto a plane perpendicular to the longitudinal axis L (best seen in FIG. 32). The first drafted side surface 932 and the second vertical surface 934 may at least partially border a notch 926 configured to receive an insert 928.

Figure 33:
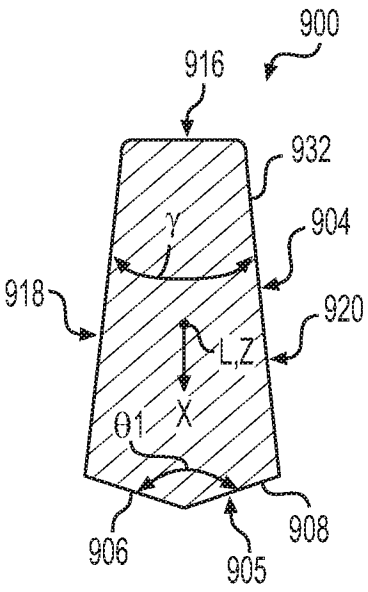
FIG. 33 is a cross-section of the penetration grader tool bit of FIG. 30 taken along lines 33-33 thereof.
Figure 34:
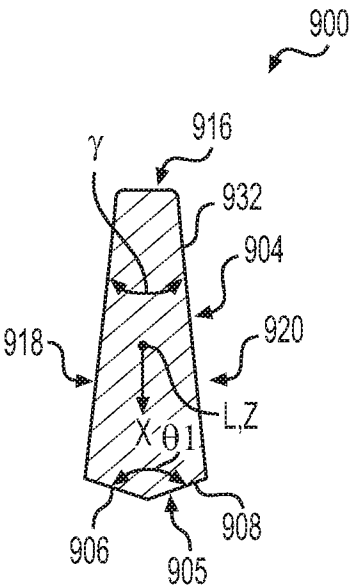
FIG. 34 is a cross-section of the penetration grader tool bit of FIG. 30 taken along lines 34-34 thereof.

FIGS. 32 thru 34 show how the cross-section of the tool bit 900 changes over time as the tool bit 900 wears. FIG. 34 shows a first state of initial wear. FIG. 33 shows an intermediate state of wear while FIG. 32 shows an advanced state of wear. Polygonal cross-sections, such nearly trapezoidal cross-sections, are formed.

Looking at FIGS. 35 thru 40, a tool bit 1000 (e.g. a wide mining tool bit, similarly configured as the wide grading bit except that the working proton is longer axially and includes an extra insert, etc.) for use with a blade assembly 100 of a grading machine 10 is illustrated. The tool bit 1000 comprises a shank portion 1002 defining a longitudinal axis L, and a working portion 1004. The working portion 1004 includes a rear region 1016, a front working region 1005, a first side region 1018 and a second side region 1020, and the first side region 1018 and the second side region 1020 may define an angle of extension γ measured in a plane perpendicular to the longitudinal axis L, forming a wider front working region 1005 than the rear region 1016 in a plane perpendicular to the longitudinal axis L. The angle of extension γ may range from 0 to 40 degrees. The front working region 1005 is so called since this region that predominantly performs the work when contacting or penetrating the ground or other work surface.

The shank portion 1002 may include a cylindrical configuration defining a circumferential direction C and a radial direction R. The rear region 1016 may at least partially form a right angle RA with the radial direction R in a plane perpendicular to the longitudinal axis L (best seen in FIGS. 38 thru 40).

The front working region 1005 may include a first angled surface 1006 and a second angled surface 1008 forming a first included angle Θ1 with the first angled surface 1006 projected along the longitudinal axis L onto a plane perpendicular to the longitudinal axis L ranging from 150 to 180 degrees. Similarly, the front working region 1005 may further comprise a third angled surface 1010 forming a first external angle α1 with the second angled surface 1008 projected along the longitudinal axis L onto a plane perpendicular to the longitudinal axis L ranging from 150 to 180 degrees. Likewise, the front working region 1005 further comprises a fourth angled surface 1011 forming a second included angle Θ2 with the third angled surface 1010 projected along the longitudinal axis L onto a plane perpendicular to the longitudinal axis L ranging from 150 to 180 degrees.

The first side region 1018 or second side region 1020 may include a first drafted side surface 1032 configured to reduce drag of the tool bit 1000 along the longitudinal axis L in use. For the embodiment shown in FIGS. 35 and 40, this surface may have little to no draft (e.g. 0 to 5 degrees). In many embodiments such as that shown in FIGS. 36 thru 40, the tool bit 1000 is symmetrical about an X-Z plane of a Cartesian coordinate system with its origin O on the longitudinal axis L and its X-axis aligned with the cross-hole 1014 passing through the flat surfaces 1012 of the shank portion 1002.

Figure 35:
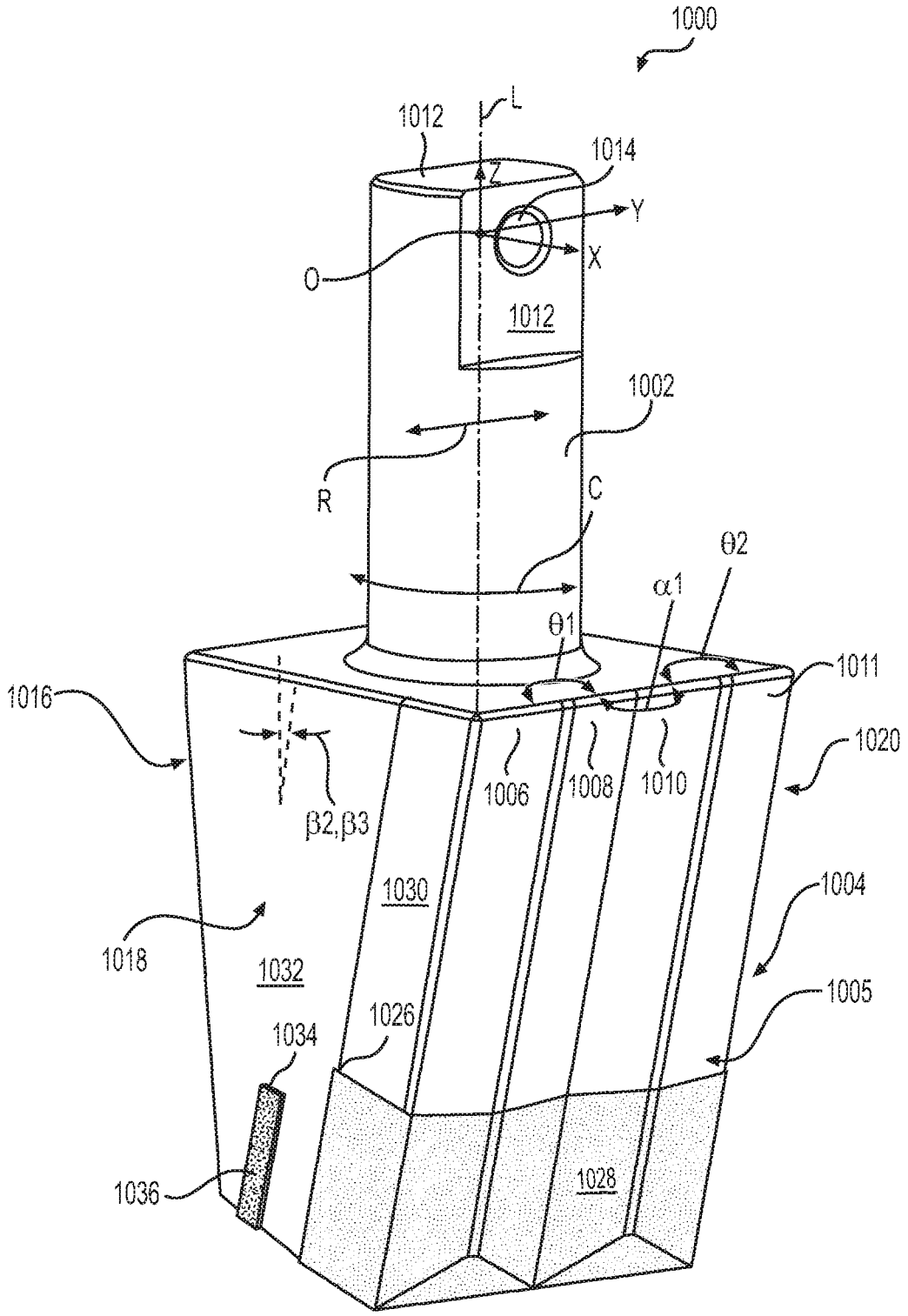
FIG. 35 is a perspective view of a wide mining tool bit with an additional insert, helping to prolong the useful life of the tool bit, and also lacking arcuate surfaces.
Figure 36:
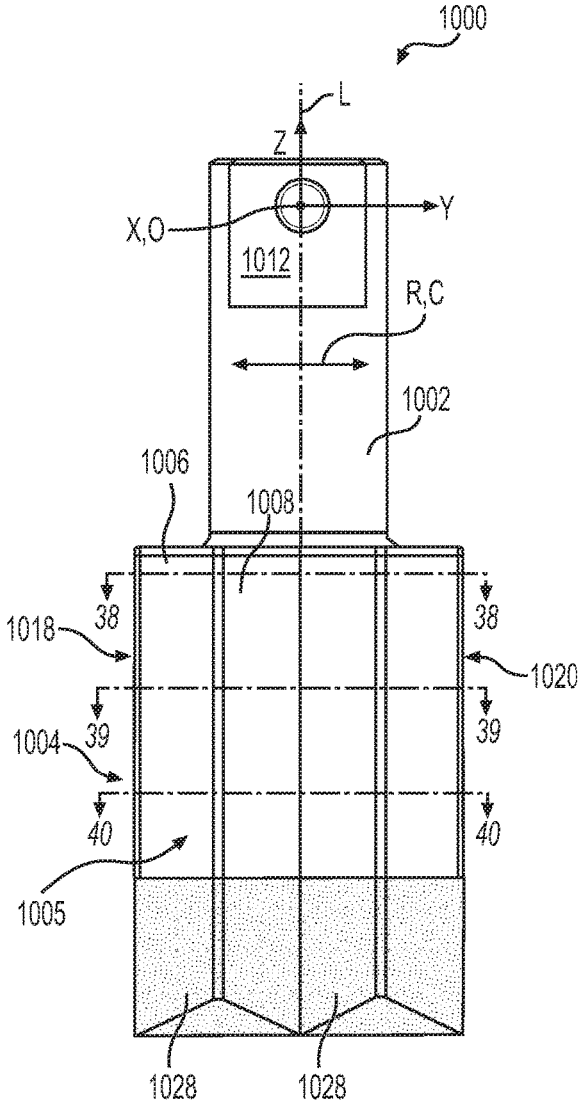
FIG. 36 is a front view of the wide mining tool bit of FIG. 35.
Figure 37:
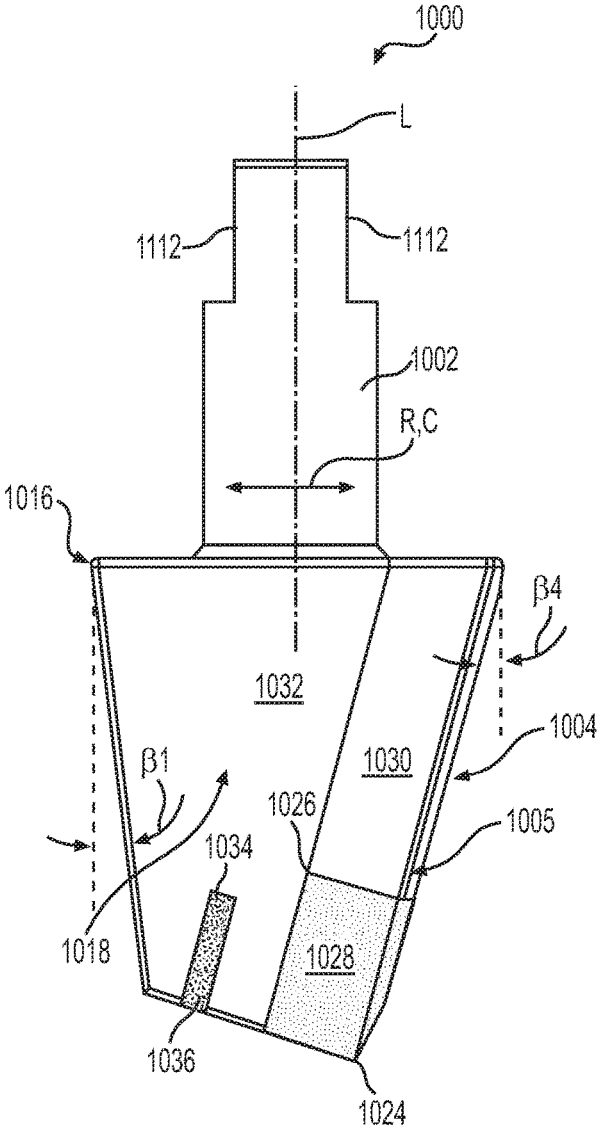
FIG. 37 is a side view of the wide mining tool bit of FIG. 35.

Referring to FIGS. 35 and 37, the rear region 1016 may form a first draft angle β1 with the longitudinal axis L measured in a plane containing the radial direction R and the longitudinal axis L, the first draft angle β1 ranging from 0 to 30 degrees. The first side region 1018 may form a second draft angle β2 with the longitudinal axis L measured in a plane containing the radial direction R and the longitudinal axis L, ranging from 0 to 30 degrees. The second side region 1020 may form a third draft angle β3 with the longitudinal axis L measured in a plane containing the radial direction R and the longitudinal axis L, ranging from 0 to 30 degrees. The front working region 1005 may form a fourth draft angle β4 with the longitudinal axis L measured in a plane containing the radial direction R and the longitudinal axis L, ranging from 0 to 30 degrees. β2 and β3 are negative draft angles as seen in FIGS. 38 thru 40 since the width of the cross-section of the working portion 1004 is decreasing as one progresses upwardly along the longitudinal axis L.

This tool bit 1000 may be further describe as follows with reference to FIGS. 35 thru 40. A tool bit 1000 for use with a blade assembly 100 of a grading machine 10 may comprise a shank portion 1002 defining a longitudinal axis L, and a working portion 1004. The working portion 1004 includes a rear region 1016, a front working region 1005, a first side region 1018 and a second side region 1020, and the first side region 1018 or the second side region 1020 include a first vertical surface 1030 disposed longitudinally adjacent the shank portion 1002, and a first drafted side surface 1032 configured to reduce drag of the tool bit 1000 through the ground or other work surface extending from the first vertical surface 1030.

The first drafted side surface 1032 may extend downwardly longitudinally from or past the first vertical surface 1030 and the working portion 1005 and terminate at the free axial end 1024 of the tool bit 1000. The first drafted surface 1032 forms at least partially a first obtuse included angle φ1 with the rear region 1016 projected along the longitudinal axis L onto a plane perpendicular to the longitudinal axis L, ranging from 90 to 120 degrees. The first drafted side surface 1032 and the first vertical surface 1030 may at least partially border a notch 1026 configured to receive an insert 1028.

Figure 40:
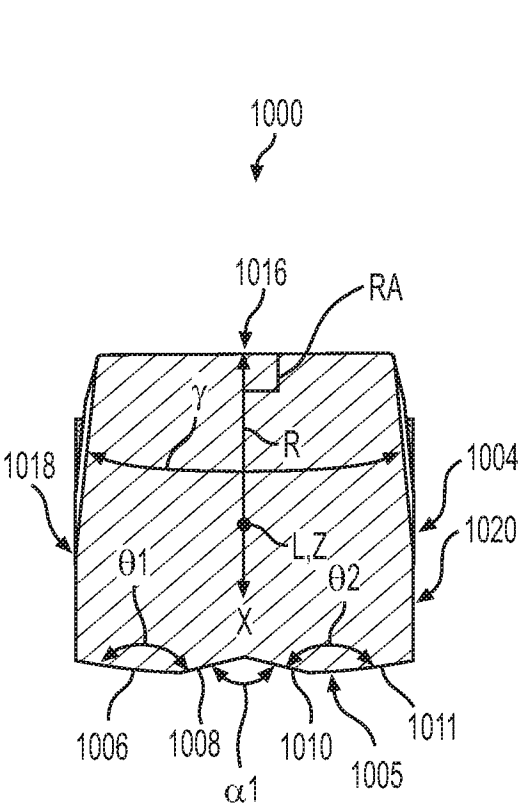
FIG. 40 is a cross-section of the wide mining tool bit of FIG. 36 taken along lines 40-40 thereof.
Figure 39:
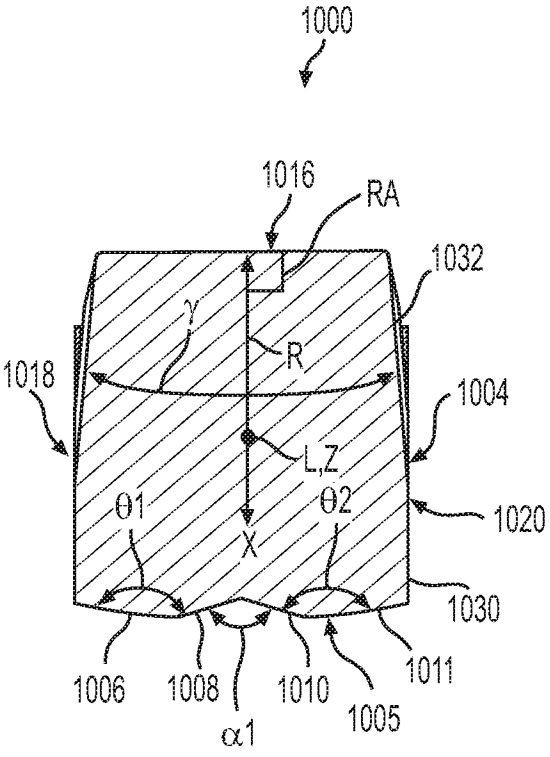
FIG. 39 is a cross-section of the wide mining tool bit of FIG. 36 taken along lines 39-39 thereof.
Figure 38:
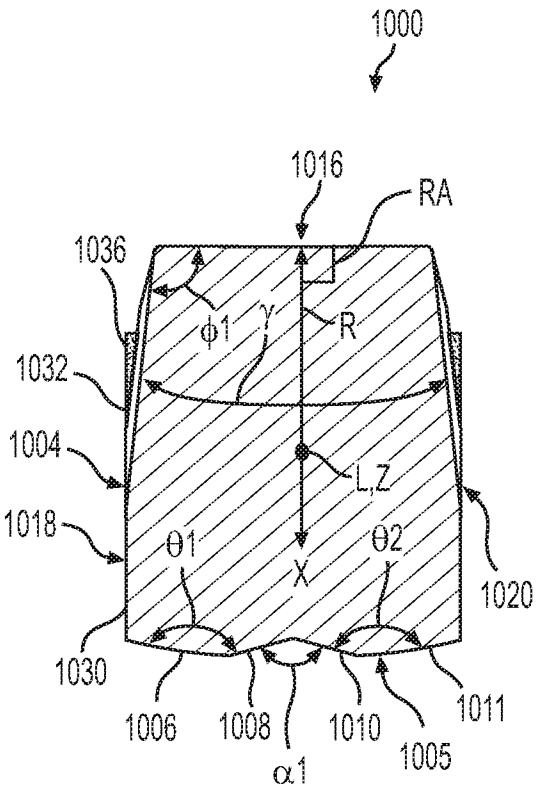
FIG. 38 is a cross-section of the wide mining tool bit of FIG. 36 taken along lines 38-38 thereof.
Figure 41:
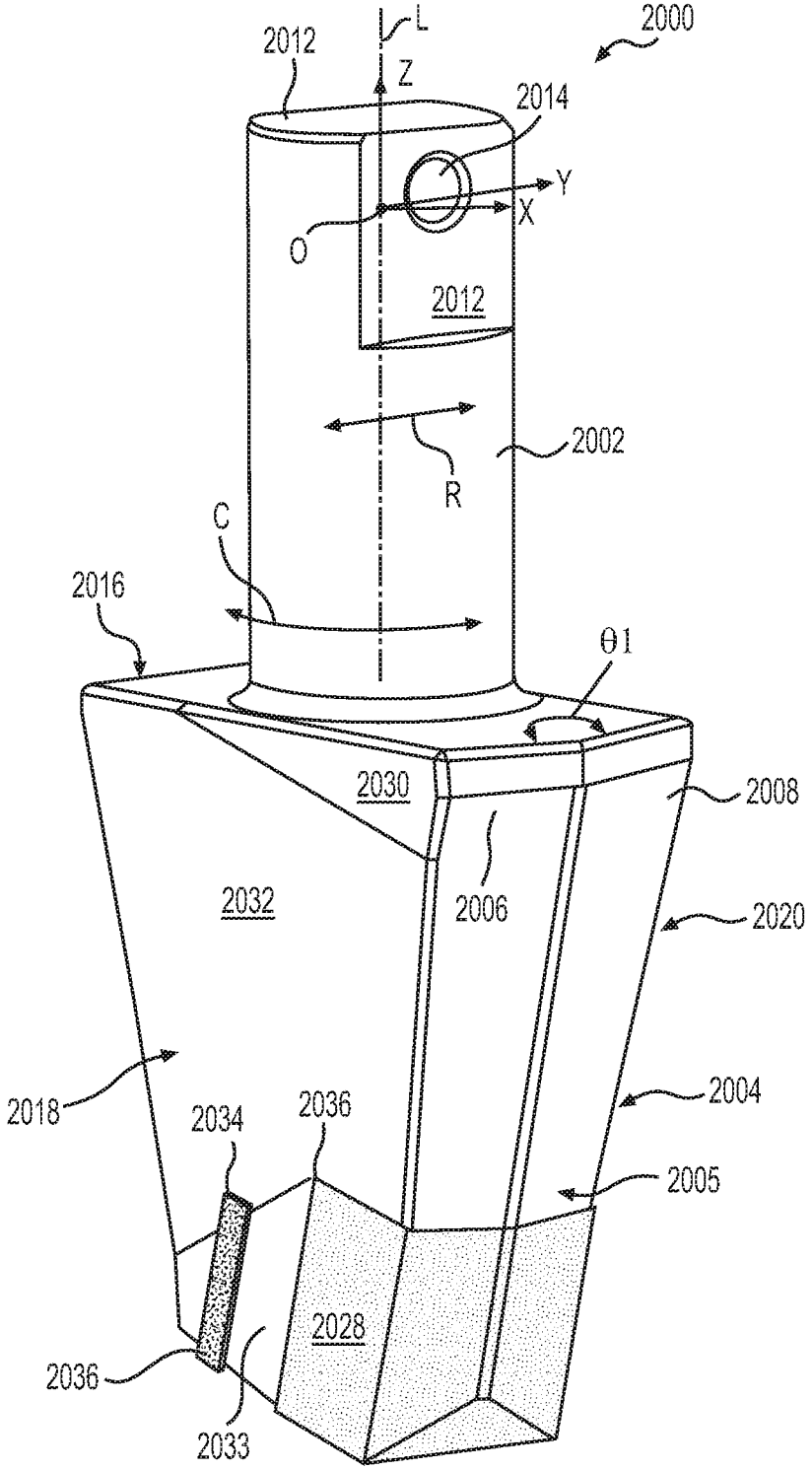
FIG. 41 is a perspective view of a standard mining tool bit with an additional insert, helping to prolong the useful life of the tool bit, and also lacking arcuate surfaces.

FIGS. 38 thru 40 show how the cross-section of the tool bit 1000 changes over time as the tool bit wears. FIG. 40 shows a first state of initial wear. FIG. 39 shows an intermediate state of wear while FIG. 38 shows an advanced state of wear. Polygonal cross-sections, such nearly trapezoidal cross-sections, are formed.

The working portion 1004 of this tool bit 1000 further defines a slot 1034 extending along a direction parallel to the Y-axis, from one drafted side surface 1032 of the first side region 1018 to the other drafted side surface 1032 of second side region 1020. An extra reinforcement insert 1036 may be disposed therein made of a similar material and/or having similar properties as the other insert 1028.

Looking at FIGS. 41 thru 46, a tool bit 2000 (e.g. a standard mining tool bit, similarly configured as the wide mining bit except that the working portion is more narrow, etc.) for use with a blade assembly 100 of a grading machine 10 is illustrated. The tool bit 2000 comprises a shank portion 2002 defining a longitudinal axis L, and a working portion 2004. The working portion 2004 includes a rear region 2016, a front working region 2005, a first side region 2018 and a second side region 2020, and the first side region 2018 and the second side region 2020 may define an angle of extension γ measured in a plane perpendicular to the longitudinal axis L, forming a wider front working region 2005 than the rear region 2016 in a plane perpendicular to the longitudinal axis L. The angle of extension γ may range from 0 to 40 degrees. The front working region 2005 is so called since this region that predominantly performs the work when contacting or penetrating the ground or other work surface.

The shank portion 2002 may include a cylindrical configuration defining a circumferential direction C and a radial direction R. The rear region 2016 may at least partially form a right angle RA with the radial direction R in a plane perpendicular to the longitudinal axis L (best seen in FIG. 44).

The front working region 2005 may include a first angled surface 2006 and a second angled surface 2008 forming a first included angle Θ1 with the first angled surface 2006 projected along the longitudinal axis L onto a plane perpendicular to the longitudinal axis L ranging from 140 to 180 degrees. The first side region 2018 or second side region 2020 may include a first drafted side surface 2032 configured to improve penetration of the tool bit 2000 along the longitudinal axis L in use. In many embodiments such as that shown in FIGS. 41 thru 46, the tool bit 2000 is symmetrical about an X-Z plane of a Cartesian coordinate system with its origin O on the longitudinal axis L and its X-axis aligned with the cross-hole 2014 passing through the flat surfaces 2012 of the shank portion 2002.

Figure 42:
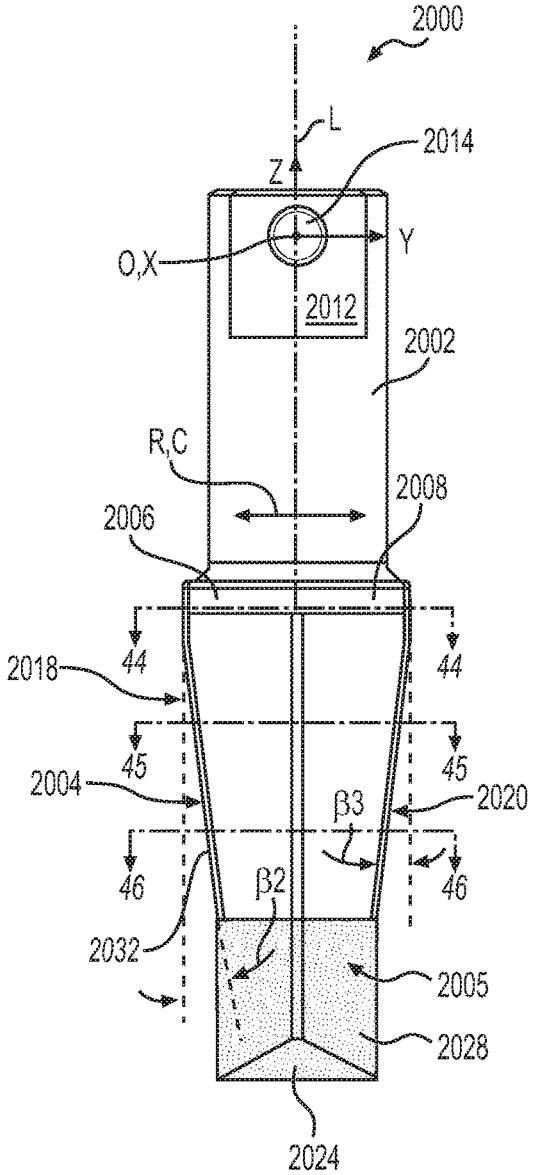
FIG. 42 is a front view of the standard mining tool bit of FIG. 41.
Figure 43:
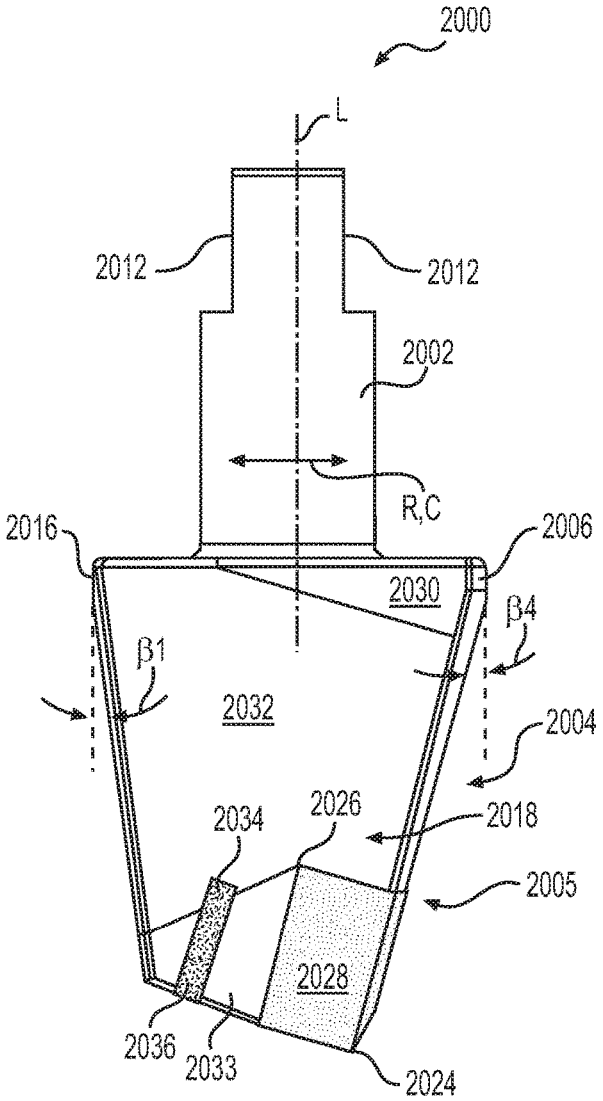
FIG. 43 is a side view of the standard mining tool bit of FIG. 41.

Referring to FIGS. 42 and 43, the rear region 2016 may form a first draft angle β1 with the longitudinal axis L measured in a plane containing the radial direction R and the longitudinal axis L, the first draft angle β1 ranging from 0 to 30 degrees. The first side region 2018 may form a second draft angle β2 with the longitudinal axis L measured in a plane containing the radial direction R and the longitudinal axis L, ranging from 0 to 40 degrees. The second side region 2020 may form a third draft angle β3 with the longitudinal axis L measured in a plane containing the radial direction R and the longitudinal axis L, ranging from 0 to 40 degrees. The front working region 2005 may form a fourth draft angle β4 with the longitudinal axis L measured in a plane containing the radial direction R and the longitudinal axis L, ranging from 0 to 30 degrees. β2 and β3 are positive draft angles as seen in FIGS. 38 thru 40 since the width of the cross-section of the working portion 2004 is increasing as one progresses upwardly along the longitudinal axis L.

This tool bit 2000 may be further describe as follows with reference to FIGS. 41 thru 46. A tool bit 2000 for use with a blade assembly 100 of a grading machine 10 may comprise a shank portion 2002 defining a longitudinal axis L, and a working portion 2004. The working portion 2004 includes a rear region 2016, a front working region 2005, a first side region 2018 and a second side region 2020, and the first side region 2018 or the second side region 2020 include a first vertical surface 2030 disposed longitudinally adjacent the shank portion 2002, and a first drafted side surface 2032 configured to improve penetration of the tool bit 2000 into the ground or other work surface extending from the first vertical surface 2030.

The first drafted side surface 2032 may extend downwardly longitudinally from or past the first vertical surface 2030 and the working portion 2005 and terminate at the free axial end 2024 of the tool bit 2000. The first drafted surface 2032 forms at least partially a first obtuse included angle φ1 with the rear region 2016 projected along the longitudinal axis L onto a plane perpendicular to the longitudinal axis L, ranging from 90 to 120 degrees. A second vertical surface 2033 may extend downwardly from the first drafted side surface 2032, both of which may at least partially border a notch 2026 configured to receive an insert 2028.

Figure 46:
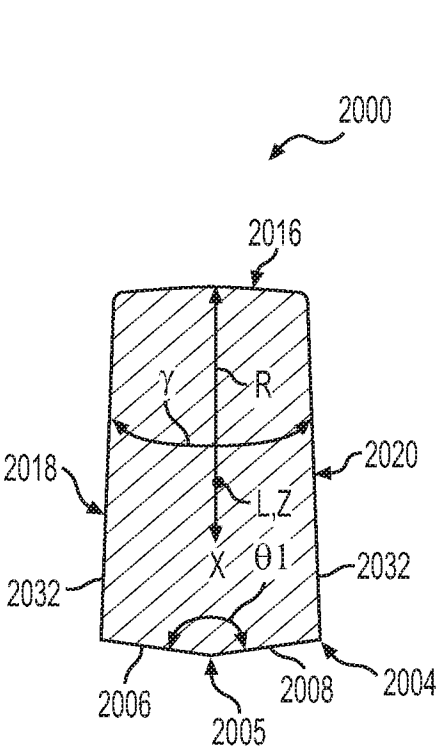
FIG. 46 is a cross-section of the standard mining tool bit of FIG. 42 taken along lines 46-46 thereof.
Figure 45:
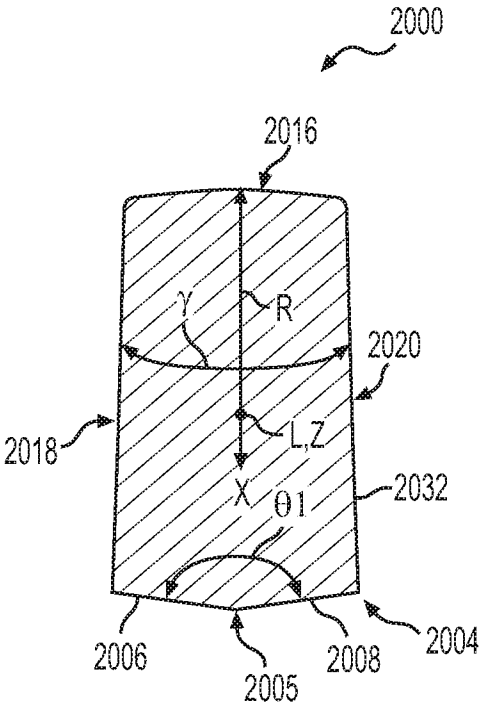
FIG. 45 is a cross-section of the standard mining tool bit of FIG. 42 taken along lines 45-45 thereof.
Figure 44:
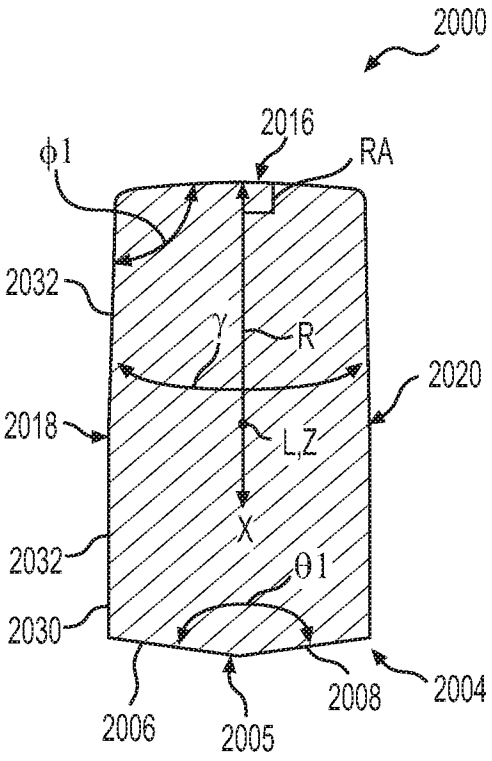
FIG. 44 is a cross-section of the standard mining tool bit of FIG. 42 taken along lines 44-44 thereof.

FIGS. 44 thru 46 show how the cross-section of the tool bit 2000 changes over time as the tool bit wears. FIG. 46 shows a first state of initial wear. FIG. 45 shows an intermediate state of wear while FIG. 44 shows an advanced state of wear. Polygonal cross-sections, such nearly trapezoidal cross-sections, are formed.

The working portion 2004 of this tool bit 2000 further defines a slot 2034 extending along a direction parallel to the Y-axis, from one drafted side surface 2032 of the first side region 2018 to the other drafted side surface 2032 of second side region 2020. An extra reinforcement insert 2036 may be disposed therein made of a similar material and/or having similar properties as the other insert 1028.

Figure 47:
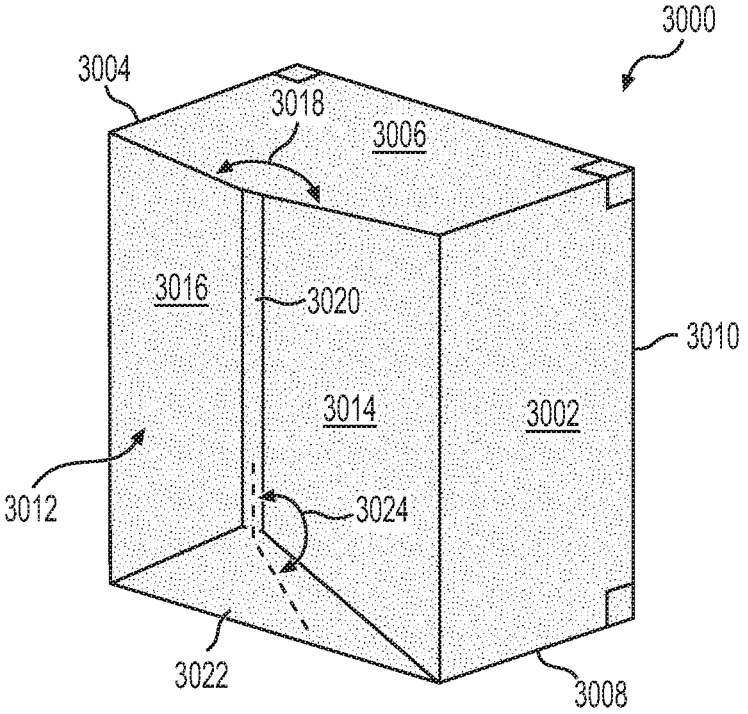
FIG. 47 is a perspective view of an insert according to a first embodiment of the present disclosure.

FIG. 47 illustrates an insert (may also be referred to as a tile) that may be similarly or identically configured as the insert used in FIGS. 3, 4, 11, 17, 35, and 42. It should be noted that the geometry of the insert may be doubled in a single insert or two similar inserts may be used side by side such as shown in FIG. 11, etc. Accordingly, the insert 3000 is configured to be attached to the notch of a tool bit for use with a grading machine as previously described. The insert 3000 may comprise a first side face 3002, a second side face 3004, a top face 3006, a bottom face 3008, a rear face 3010, and a front region 3012 including a first flat face 3014, and a second flat face 3016 forming an obtuse included angle 3018 with the first flat face 3014 on the top face 3006 ranging from 130 to 180 degrees.

The first side face 3002 may be perpendicular to the rear face 3010 and to the top face 3006 and may be parallel to the second side face 3004. The insert 300 may further comprise a blend 3020 transitioning from the first flat surface 3014 to the second flat surface 3016 and a bottom face 3008 that forms right angles with the rear face 3010, the first side face 3002, and the second side face 3004. The insert 3000 further comprises a chamfered surface 3022 connecting the first flat face 3014, second flat face 3016, blend 3020 and the bottom face 3008. The chamfered surface 3022 may from a chamfer angle 3024 with bottom face ranging from 120 to 180 degrees. It should be noted that the first side face 3002 and second side face 3004, and the associated obtuse included angle 3018 may be designed to match to the corresponding surfaces of a tool bit and vice versa. Any of the angles may be varied as needed or desired in any embodiment.

Figure 48:
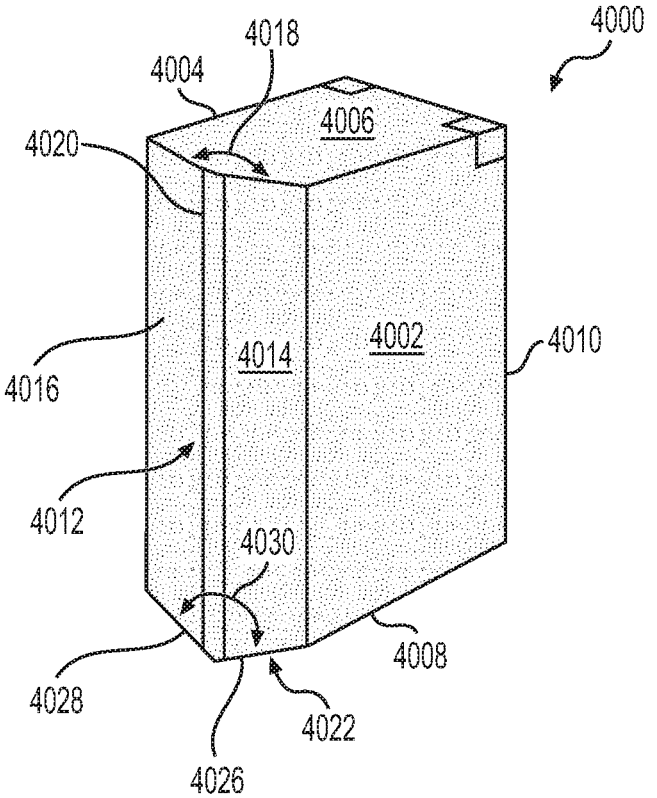
FIG. 48 is a perspective view of an insert according to a second embodiment of the present disclosure.

FIG. 48 illustrates an insert (may also be referred to as a tile) that may be similarly or identically configured as the insert used in FIGS. 5, 6, 23 and 29. The insert 4000 is configured to be attached to the notch of a tool bit for use with a grading machine as previously described. The insert 4000 may comprise a first side face 4002, a second side face 4004, a top face 4006, a bottom face 4008, a rear face 4010, and a front region 4012 including a first flat face 4014, and a second flat face 4016 forming an obtuse included angle 4018 with the first flat face 4014 on the top face 4006 ranging from 120 to 180 degrees.

The first side face 4002 may be perpendicular to the rear face 4010 and to the top face 4006 and may be parallel to the second side face 4004. The insert 4000 may further comprise a blend 4020 transitioning from the first flat surface 4014 to the second flat surface 4016 and a bottom face 4008 that forms right angles with the rear face 4010, the first side face 4002, and the second side face 4004. The insert 4000 may further comprise a bottom region 4022, similarly configured to the front region 4012, allowing the geometry to wrap around the bottom of the insert 4000. The bottom region 4022 may form a bottom obtuse angle 4024 with the rear face 4010 ranging from 90 to 140 degrees (see FIGS. 30 and 31). The bottom region 4002 includes a third flat face 4026 and a fourth flat face 4028 that form a bottom included angle 4030 with each other that may match the obtuse included angle.

The bottom and rear regions of a tool bit using such inserts 3000, 4000 may have faceted features that allow the included angle of the front region to extend from the top of the front region about the bottom of the tool bit up to the top portion of the rear region of the tool bit. For examples, see FIGS. 13 and 31.

Again, it should be noted that any of the dimensions, angles, surface areas and/or configurations of various features may be varied as desired or needed including those not specifically mentioned herein. Although not specifically discussed, blends such as fillets are shown in FIGS. 3 thru 48 to connect the various surfaces. These may be omitted in other embodiments and it is to be understood that their presence may be ignored sometimes when reading the present specification.

INDUSTRIAL APPLICABILITY

In practice, a machine, a blade assembly, a tool bit, and/or an insert may be manufactured, bought, or sold to retrofit a machine, a tool bit, a or blade assembly in the field in an aftermarket context, or alternatively, may be manufactured, bought, sold or otherwise obtained in an OEM (original equipment manufacturer) context.

Once installed, the tool bit 200, 300, 400, 500 may be rotated as illustrated in FIGS. 7 thru 10 relative to the adapter board 200. Due to the radius of curvature ROC of any arcuate surface 206, 306, 406, 506 (see FIGS. 3 thru 6), the tool bit 200, 300, 400, 500 is better supported by the adapter board 200, helping the tool bit 200, 300, 400, 500 and associated inserts 228, 328, 428, 528 (when used) to resist fracture or wear as the blade assembly 100 is used.

In other embodiments, the tool bits and/or inserts may be drafted as appropriate to provide the desired performance. For example, the ability of the tool bit or insert may be achieved by adjusting the geometry of the tool bit appropriately.

It will be appreciated that the foregoing description provides examples of the disclosed assembly and technique. However, it is contemplated that other implementations of the disclosure may differ in detail from the foregoing examples. All references to the disclosure or examples thereof are intended to reference the particular example being discussed at that point and are not intended to imply any limitation as to the scope of the disclosure more generally. All language of distinction and disparagement with respect to certain features is intended to indicate a lack of preference for those features, but not to exclude such from the scope of the disclosure entirely unless otherwise indicated.

Recitation of ranges of values herein are merely intended to serve as a shorthand method of referring individually to each separate value falling within the range, unless otherwise indicated herein, and each separate value is incorporated into the specification as if it were individually recited herein.

It will be apparent to those skilled in the art that various modifications and variations can be made to the embodiments of the apparatus and methods of assembly as discussed herein without departing from the scope or spirit of the invention(s). Other embodiments of this disclosure will be apparent to those skilled in the art from consideration of the specification and practice of the various embodiments disclosed herein. For example, some of the equipment may be constructed and function differently than what has been described herein and certain steps of any method may be omitted, performed in an order that is different than what has been specifically mentioned or in some cases performed simultaneously or in sub-steps. Furthermore, variations or modifications to certain aspects or features of various embodiments may be made to create further embodiments and features and aspects of various embodiments may be added to or substituted for other features or aspects of other embodiments in order to provide still further embodiments.

Accordingly, this disclosure includes all modifications and equivalents of the subject matter recited in the claims appended hereto as permitted by applicable law. Moreover, any combination of the above-described elements in all possible variations thereof is encompassed by the disclosure unless otherwise indicated herein or otherwise clearly contradicted by context.

What is claimed is:

1. A tool bit for use with a blade assembly of a grading machine, the tool bit comprising:

a shank portion defining a longitudinal axis; and a working portion extending downwardly axially from the shank portion;

wherein the working portion includes a rear region, a front working region, a first side region and a second side region, and the first side region and the second side region define an angle of extension measured in a plane perpendicular to the longitudinal axis, forming a wider front working region than the rear region in a plane perpendicular to the longitudinal axis; and the front working region includes a first angled surface and a second angled surface forming a first included angle with the first angled surface projected along the longitudinal axis onto a plane perpendicular to the longitudinal axis ranging from 150 to less than 180 degrees.

2. The tool bit of claim 1 wherein the shank portion includes a cylindrical configuration defining a circumferential direction and a radial direction and the rear region at least partially forms a right angle with the radial direction in a plane perpendicular to the longitudinal axis.

3. The tool bit of claim 1 wherein the front working region further comprises a third angled surface forming a first external angle with the second angled surface projected along the longitudinal axis onto a plane perpendicular to the longitudinal axis ranging from 150 to 180 degrees, forming a serrated cutting edge.

4. The tool bit of claim 3 wherein the front working region further comprises a fourth angled surface forming a second included angle with the third angled surface projected along the longitudinal axis onto a plane perpendicular to the longitudinal axis ranging from 150 to 180 degrees.

5. The tool bit of claim 1 wherein the first side region or second side region include a first drafted side surface configured to improve penetration of the tool bit in use.

6. The tool bit of claim 1 wherein the first side region or the second side region include a first drafted side surface that forms an angle less than 5 degrees with the longitudinal axis, and is configured to reduce drag of the tool bit in use.

7. The tool bit of claim 2 wherein the rear region forms a first draft angle with the longitudinal axis measured in a plane containing the radial direction and the longitudinal axis, ranging from 0 to 40 degrees, the first side region forming a second draft angle with the longitudinal axis measured in a plane containing the radial direction and the longitudinal axis, ranging from 0 to 40 degrees, the second side region forming a third draft angle with the longitudinal axis measured in a plane containing the radial direction and the longitudinal axis, ranging from 0 to 40 degrees, and the front working region forms a fourth draft angle with the longitudinal axis measured in a plane containing the radial direction and the longitudinal axis, ranging from 0 to 30 degrees.

8. A tool bit for use with a blade assembly of a grading machine, the tool bit comprising:

a shank portion defining a longitudinal axis; and a working portion extending downwardly axially from the shank portion;

wherein the working portion includes a rear region, a front working region, a first side region and a second side region, and the first side region or the second side region includes a first undrafted vertical surface disposed longitudinally adjacent the shank portion, and a first drafted side surface extending from the first undrafted vertical surface.

9. The tool bit of claim 8 wherein the first drafted side surface extends downwardly longitudinally past the first undrafted vertical surface and the working portion includes a second undrafted vertical surface extending downwardly longitudinally from the first drafted side surface.

10. The tool bit of claim 9 wherein the first drafted side surface forms at least partially a first included obtuse angle with the rear region projected along the longitudinal axis onto a plane perpendicular to the longitudinal axis.

11. The tool bit of claim 9 wherein the first drafted side surface and the second undrafted vertical surface at least partially border a notch configured to receive an insert.

12. The tool bit of claim 8 wherein the first side region and the second side region define an angle of extension measured in a plane perpendicular to the longitudinal axis, forming a wider front working region than the rear face in a plane perpendicular to the longitudinal axis.

13. The tool bit of claim 12 wherein the front working region includes a first angled surface and a second angled surface forming a first included angle with the first angled surface projected along the longitudinal axis onto a plane perpendicular to the longitudinal axis ranging from 150 to 180 degrees.

14. The tool bit of claim 8 wherein the shank portion includes a cylindrical configuration defining a circumferential direction and a radial direction and the rear region at least partially forms a right angle with the radial direction in a plane perpendicular to the longitudinal axis.

15. The tool bit of claim 14 wherein the rear region forms a first draft angle with the longitudinal axis measured in a plane containing the radial direction and the longitudinal axis, ranging from 0 to 40 degrees, the first side region forming a second draft angle with the longitudinal axis measured in a plane containing the radial direction and the longitudinal axis, ranging from 0 to 40 degrees, the second side region forming a third draft angle with the longitudinal axis measured in a plane containing the radial direction and the longitudinal axis, ranging from 0 to 40 degrees, and the front working region forms a fourth draft angle with the longitudinal axis measured in a plane containing the radial direction and the longitudinal axis.

16. An insert configured to be attached to the notch of a tool bit for use with a grading machine, the insert comprising:

a first side face;

a second side face;

a top face;

a bottom face;

a rear face; and a front region including a first flat face, and a second flat face forming an obtuse included angle with the first flat face on the top face ranging from 120 to less than 180 degrees.

17. An insert of claim 16 wherein the first side face is perpendicular to the rear face and the top face and is parallel to the second side face and further comprises a blend transitioning from the first side surface to the second flat surface.

18. The insert of claim 17 further comprising a bottom face that forms right angles with the rear face, the first side face, and the second side face, the insert further comprising a chamfered surface connecting the first flat face, second flat face, blend and the bottom face.

19. The insert of claim 17 further comprising a bottom region that forms an bottom obtuse angle with the rear face, the bottom region includes a third flat face and a fourth flat face that form a bottom included angle with each other, the bottom included angle matching the obtuse included angle.

* * * * *